US005493798A

United States Patent [19]

Rocke et al.

[11] Patent Number: 5,493,798

[45] Date of Patent: Feb. 27, 1996

[54] TEACHING AUTOMATIC EXCAVATION CONTROL SYSTEM AND METHOD

[75] Inventors: David J. Rocke, Eureka; Lonnie J. Devier, Dunlap; Dale B. Herget, Peoria Heights, all of Ill.

[73] Assignee: Caterpillar Inc., Peoria, Ill.

[21] Appl. No.: 260,427

[22] Filed: Jun. 15, 1994

[51] Int. Cl.[6] ..... E02F 3/34

[52] U.S. Cl. ..... 37/348; 364/424.07; 414/694; 414/699

[58] Field of Search ..... 172/260.5, 2, 4, 172/4.5, 777; 37/347, 348, 414, 416, 417; 414/694, 695.5, 697, 699, 700, 701, 727; 91/361, 459; 364/424.07, 508, 559

[56] References Cited

U.S. PATENT DOCUMENTS

| | | | |
|---|---|---|---|
| 3,583,585 | 6/1971 | Joyce | 214/138 |
| 3,869,814 | 3/1975 | Rannev et al. | 37/397 |
| 4,332,517 | 6/1982 | Igarashi et al. | 414/699 |
| 4,377,043 | 3/1983 | Inui et al. | 37/18 R |
| 4,500,250 | 2/1985 | Maurer et al. | 414/695.5 |
| 4,866,641 | 9/1989 | Nielsen et al. | 172/4.5 X |
| 4,910,673 | 3/1990 | Narisawa et al. | 364/424.07 |
| 5,002,454 | 3/1991 | Hadank et al. | 414/695.5 |
| 5,065,326 | 11/1991 | Sahm | 364/424.07 |
| 5,116,186 | 5/1992 | Hanamoto et al. | 414/694 |
| 5,128,599 | 7/1992 | Nikolaus et al. | 318/685 |
| 5,160,239 | 11/1992 | Allen et al. | 414/699 |
| 5,170,342 | 12/1992 | Nakamura et al. | 364/167.01 |
| 5,178,510 | 1/1993 | Hanamoto et al. | 414/694 |
| 5,188,502 | 2/1993 | Tonsor et al. | 414/700 |
| 5,218,895 | 6/1993 | Lukich et al. | 91/361 |
| 5,224,033 | 6/1993 | Nakamura et al. | 364/167.01 |
| 5,274,557 | 12/1993 | Moriya et al. | 364/424.07 |

OTHER PUBLICATIONS

"A Laboratory Study of Force–Cognitive Excavation", D. M. Bullock et al Jun. 6–8, 1989, Proceedings of the Sixth International Symposium on Automation and Robotics in Construction.

"A Microcomputer–Based Agricultural Digger Control System", E. R. I. Deane et al., Dec. 20, 1988, Computers and Electronics in Agriculture (1989), Elsevier Science Publishers.

"An Intelligent Task Control System for Dynamic Mining Environments", Paul J. A. Lever et al., pp. 1–6, Presented at 1994 SME Annual Meeting, Albuquerque, New Mexico, Feb. 14–17, 1994.

"Artificial Intelligence in the Control and Operation of Construction Plant–The Autonomous Robot Excavator", D. A. Bradley et al., Automation in Construction 2 (1993), Elsevier Science Publishers B.V.

(List continued on next page.)

*Primary Examiner*—Terry Lee Melius
*Assistant Examiner*—Robert Pezzuto
*Attorney, Agent, or Firm*—Steven R. Janda

[57] ABSTRACT

According to one aspect of the present invention, a control system for automatically controlling a work implement of an excavating machine through an excavation work cycle is provided. The work implement includes a boom, stick and bucket, each being controllably actuated by at least one respective hydraulic cylinder, the hydraulic cylinders containing pressurized hydraulic fluid. The control system includes an operator control element adapted to produce an operator control signal indicative of a desired velocity of one of the hydraulic cylinders. An electrohydraulic valve actuates predetermined ones of the hydraulic cylinders to perform an excavation work cycle in response to the control signal. A sensor produces signals indicative of the forces associated with at least one of the hydraulic cylinders. A logic device receives the operator control signals, compares the control signal magnitudes to predetermined control signal magnitudes, and determines operating parameters associated with predetermined portions of the work cycle. Finally, the logic device receives the operator control signals and force signals, and responsively produces command signals to the electrohydraulic valve to automatically perform subsequent work cycles in accordance with the determined operating parameters.

10 Claims, 19 Drawing Sheets

OTHER PUBLICATIONS

"Automated Excavator Study", James G. Cruz, A Special Research Problem Presented to the Faculty of the Construction Engineering and Management Program, Purdue University, Jul. 23, 1990.

"Cognitive Force Control of Excavators", P. K. Vaha et al. pp. 159–166. The Manuscript for this Paper was Submitted for Review and Possible Publication on Oct. 9, 1990. This Paper is part of the Journal of Aerospace Engineering, vol. 6, No. 2, Apr., 1993.

"Control and Operational Strategies for Automatic Excavation", D. A. Bradley et al., Proceedings of the Sixth International Symposium on Automation and Robotics in Construction, Jun. 6–8, 1989.

"Design of Automated Loading Buckets", P. A. Mikhirev, pp. 292–298, Institute of Mining, Siberian Branch of the Academy of Science of the USSR, Nevosibirsk. Translated from Fiziko–Tekhnicheskie Problemy Razrabotki Poleznykh Iskopaemykh, No. 4, pp. 79–86, Jul.–Aug., 1986. Original Article Submitted Sep. 28, 1984, Plenum Publishing Corporation, 1987.

"Development of Unmanned Wheel Loader System–Application to Asphalt Mixing Plant", H. Ohshima et al., Published by Komatsu, Nov. 1992.

"Just Weigh it and See", Mike Woof, p. 27, Construction News, Sep. 9, 1993.

"Method of Dipper Filling Control for a Loading–Transporting Machine Excavating Ore in Hazardous Locations", V. L. Konyukh et al., pp. 132–138, Institute of Coal, Academy of Sciences of the USSR, Siberian Branch, Kemorovo. Translated from Fiziko–Tekhnicheskie Problemy Razrabotki Poleznykh Iskopaemykh, No. 2, pp. 67–73, Mar.–Apr., 1988. Original Article Submitted Jun. 18, 1987, Plenum Publishing Corporation, 1989.

"Motion and Path Control for Robotic Excavation", L. E. Bernold, Sep., 1990, Submitted to the ASCE Journal of Aerospace Engrg.

Patent Application No. 08/216,386, filed Mar. 23, 1994, Entitled "Automatic Excavation Control System and Method", David J. Rocke, Docket No. 93–328.

Patent Application No. 08/216,395, filed Mar. 23, 1994, Entitled "Payload Determining System and Method for an Excavating Machine", David J. Rocke et al., Docket No. 93–327.

Patent Application No. 08/217,033 filed Mar. 23, 1994, Entitled "Self–Adapting Excavation Control System and Method", David J. Rocke, Docket No. 93–330.

Patent Application No. 08/217,034, filed Mar. 23, 1994, Entitled "System and Method for Determining the Completion of a Digging Portion of an Excavation Work Cycle", David J. Rocke, Docket No. 93–326.

| AVE STK CYL FORCE (N) | MATERIAL CONDITION SETTING |
|---|---|
| 0 < F < 278000 | SETTING #1 |
| 278000 < F < 300240 | SETTING #2 |
| 300240 < F < 322480 | SETTING #3 |
| 322480 < F < 333600 | SETTING #4 |
| 333600 < F < 342496 | SETTING #5 |
| 342496 < F < 351392 | SETTING #6 |
| 351392 < F < 360288 | SETTING #7 |
| 360288 < F < 369184 | SETTING #8 |
| 369184 < F < ∞ | SETTING #9 |

Fig. 20

| AVE BKT COMMAND (% MAX) | MATERIAL CONDITION SETTING |
|---|---|
| 90 < COM | SETTING #1 |
| 75 < COM ≤ 90 | SETTING #2 |
| 60 < COM ≤ 75 | SETTING #3 |
| 50 < COM ≤ 60 | SETTING #4 |
| 37.5 < COM ≤ 50 | SETTING #5 |
| 20 < COM ≤ 37.5 | SETTING #6 |
| 10 < COM ≤ 20 | SETTING #7 |
| 5 < COM ≤ 10 | SETTING #8 |
| COM ≤ 5 | SETTING #9 |

Fig. 21

TEACHING AUTOMATIC EXCAVATION CONTROL SYSTEM AND METHOD

TECHNICAL FIELD

This invention relates generally to the field of automatic excavation and, more particularly, to a control system and method which learns the excavation work cycle of an excavating machine as defined by the operator.

BACKGROUND ART

Work machines such as excavators, backhoes, front shovels, and the like are used for excavation work. These excavating machines have work implements which consist of boom, stick and bucket linkages. The boom is pivotally attached to the excavating machine at one end, and to its other end is pivotally attached a stick. The bucket is pivotally attached to the free end of the stick. Each work implement linkage is controllably actuated by at least one hydraulic cylinder for movement in a vertical plane. An operator typically manipulates the work implement to perform a sequence of distinct functions which constitute a complete excavation work cycle.

In a typical work cycle, the operator first positions the work implement at a dig location, and lowers the work implement downward until the bucket penetrates the soil. Then the operator executes a digging stroke which brings the bucket toward the excavating machine. The operator subsequently curls the bucket to capture the soil. To dump the captured load the operator raises the work implement, swings it transversely to a specified dump location, and releases the soil by extending the stick and uncurling the bucket. The work implement is then returned to the trench location to begin the work cycle again. In the following discussion, the above operations are referred to respectively as boom-down-into-ground, dig-stroke, capture-load, swing-to-dump, dump-load, and return-to-dig.

The earthmoving industry has an increasing desire to automate the work cycle of an excavating machine for several reasons. Unlike a human operator, an automated excavating machine remains consistently productive regardless of environmental conditions and prolonged work hours. The automated excavating machine is ideal for applications where conditions are dangerous, unsuitable or undesirable for humans. An automated machine also enables more accurate excavation making up for the lack of operator skill.

Therefore, it is desirable to "teach" the automatic control the excavating work cycle as defined by the operator so that the automatic control may perform the work cycle. However, rather than simply repeat the work cycle, it may be desirable to modify the work cycle according to changes in the excavating environment to perform efficient excavating.

The present invention is directed to overcoming one or more of the problems as set forth above.

DISCLOSURE OF THE INVENTION

According to one aspect of the present invention, a control system for automatically controlling a work implement of an excavating machine through an excavation work cycle is disclosed. The work implement includes a boom, stick and bucket, each being controllably actuated by at least one respective hydraulic cylinder, the hydraulic cylinders containing pressurized hydraulic fluid. The control system includes an operator control element adapted to produce an operator control signal indicative of a desired velocity of one of the hydraulic cylinders. An electrohydraulic valve actuates predetermined ones of the hydraulic cylinders to perform an excavation work cycle in response to the control signal. A sensor produces signals indicative of the forces associated with at least one of the hydraulic cylinders. A logic device receives the operator control signals, compares the control signal magnitudes to predetermined control signal magnitudes, and determines operating parameters associated with predetermined portions of the work cycle. Finally, the logic device receives the operator control signals and force signals, and responsively produces command signals to the electrohydraulic valve to automatically perform subsequent work cycles in accordance with the determined operating parameters.

BRIEF DESCRIPTION OF THE DRAWINGS

For a better understanding of the present invention, reference may be made to the accompanying drawings in which:

FIG. 20 is a table representing a plurality of stick force values corresponding to a plurality of predetermined material condition settings;

FIG. 21 is a table representing a plurality of bucket command signal magnitudes corresponding to a plurality of predetermined material condition settings;

BEST MODE FOR CARRYING OUT THE INVENTION

Figure 1:
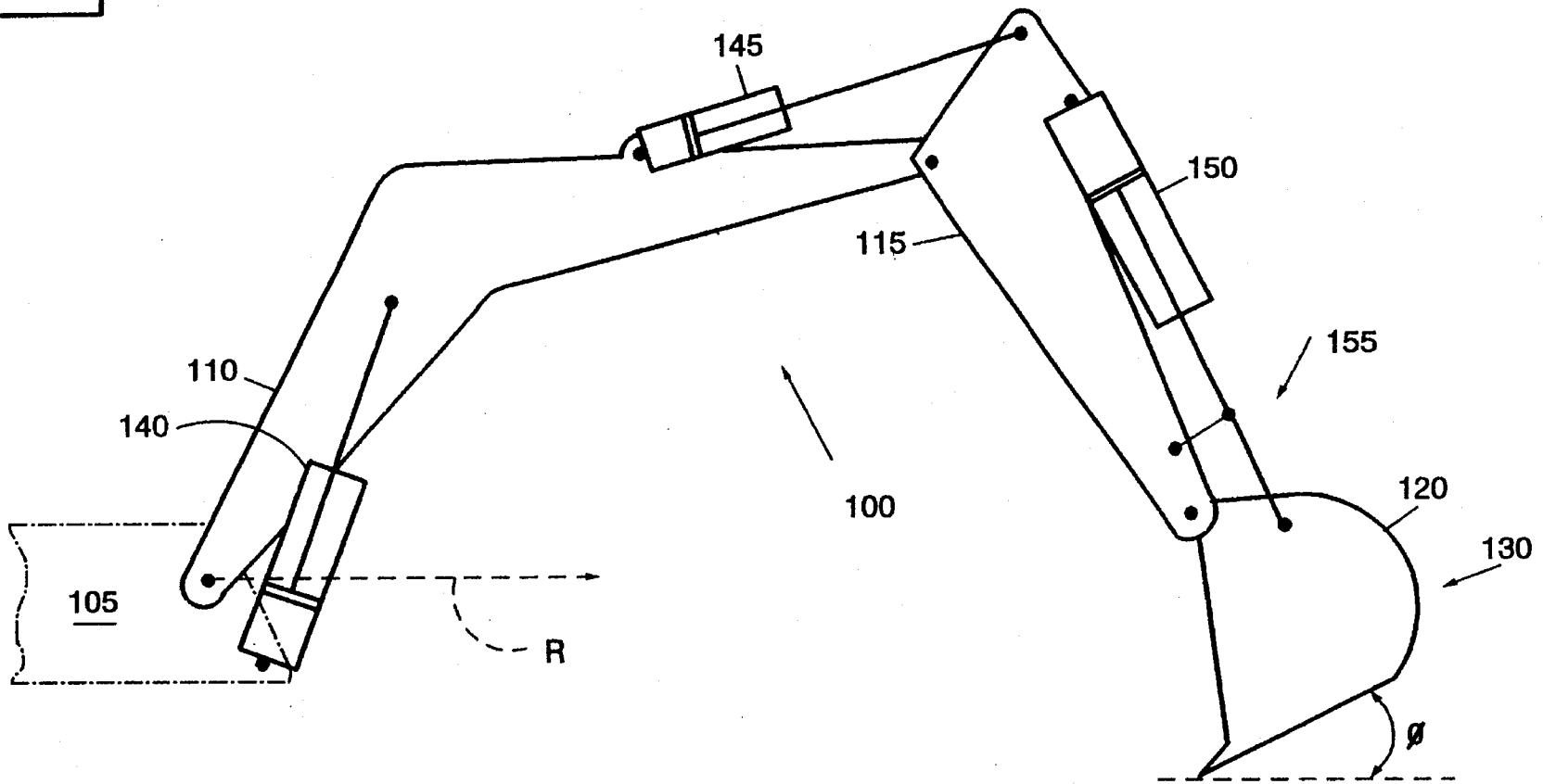
FIG. 1 is a diagrammatic view of a work implement of an excavating machine.

With reference to the drawings, FIG. 1 shows a planar view of a work implement 100 of an excavating machine, which performs digging or loading functions similar to that of an excavator, backhoe loader, and front shovel.

The excavating machine may include an excavator, power shovel, wheel loader or the like. The work implement 100 may include a boom 110 stick 115, and bucket 120. The boom 110 is pivotally mounted on the excavating machine 105. The stick 115 is pivotally connected to the free end of the boom 110. The bucket 120 is pivotally attached to the stick 115. The bucket 120 includes a rounded portion 130, a floor designated.

A horizontal reference axis, R, is defined. The axis, R, is used to measure the relative angular relationship between the work vehicle 105 and the various positions of the work implement 100.

The boom 110, stick 115 and bucket 120 are independently and controllably actuated by linearly extendable hydraulic cylinders. The boom 110 is actuated by at least one boom hydraulic cylinder 140 for upward and downward movements of the stick 115. The boom hydraulic cylinder 140 is connected between the work machine 105 and the boom 110. The stick 115 is actuated by at least one stick hydraulic cylinder 145 for longitudinal horizontal movements of the bucket 120. The stick hydraulic cylinder 145 is connected between the boom 110 and the stick 115. The bucket 120 is actuated by a bucket hydraulic cylinder 150 and has a radial range of motion. The bucket hydraulic cylinder 150 is connected to the stick 115 and a linkage. The linkage 155 is connected to the stick 115 and the bucket 120, or the purpose of illustration, only one boom, stick, and bucket hydraulic cylinder 140,145,150 is shown in FIG. 1.

To ensure an understanding of the operation of the work implement 100 and hydraulic cylinders 140,145,150 the following relationship is observed. The boom 110 is raised by extending the boom cylinder 140 and lowered by retracting the same cylinder 140. Retracting the stick hydraulic cylinders 145 moves the stick 115 away from the excavating machine 105, and extending the stick hydraulic cylinders 145 moves the stick 115 toward the machine 105. Finally, the bucket 120 is rotated away from the excavating machine 105 when the bucket hydraulic cylinder 150 is retracted, and rotated toward the machine 105 when the same cylinder 120 is extended.

Figure 2:
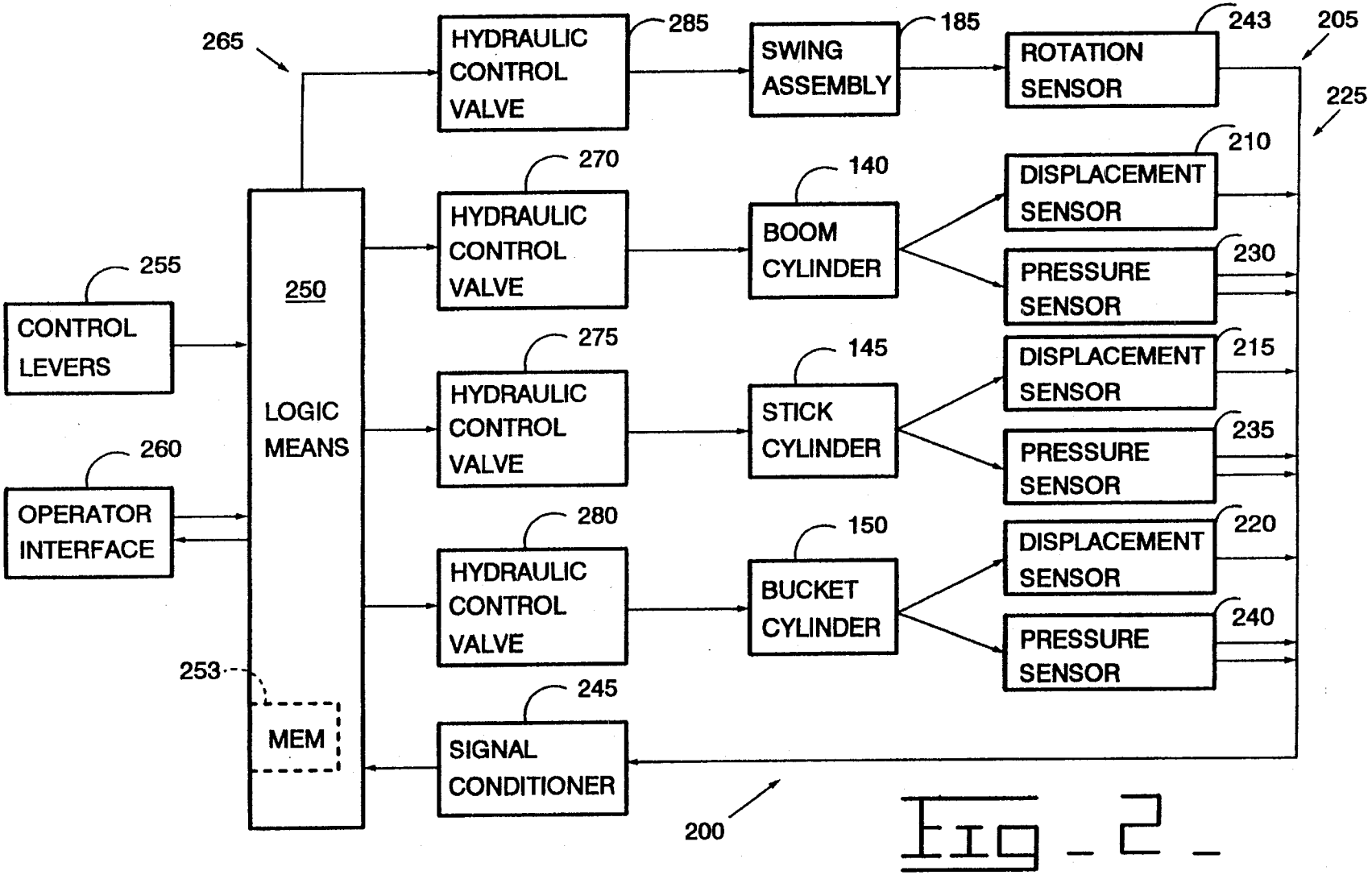
FIG. 2 is a hardware block diagram of a control system of the excavating machine.

Referring now to FIG. 2, a block diagram of an electro-hydraulic system 200 associated with the present invention is shown. A means 205 produces position signals in response to the position of the work implement 100. The means 205 includes displacement sensors 210,215,220 that sense the amount of cylinder extension in the boom, stick and bucket hydraulic cylinders 140,145,150 respectively. A radio frequency based sensor described in U.S. Pat. No. 4,737,705 issued to Bitar et al. on Apr. 12, 1988 may be used.

It is apparent that the work implement 100 position is also derivable from the work implement joint angle measurements. An alternative device for producing a work implement position signal includes rotational angle sensors such as rotatory potentiometers, for example, which measure the angles between the boom 110, stick 115 and bucket 120. The work implement position may be computed from either the hydraulic cylinder extension measurements or the joint angle measurement by trigonometric methods. Such techniques for determining bucket position are well known in the art and may be found in, for example, U.S. Pat. No. 3,997,071 issued to Teach on Dec. 14, 1976 and U.S. Pat. No. 4,377,043 issued to Inui et al. on Mar. 22, 1983.

A means 225 produces a pressure signals in response to the force exerted on the work implement 100. The means 225 includes pressure sensors 230,235,240 which measure the hydraulic pressures in the boom, stick, and bucket hydraulic cylinders 140,145,150 respectively. The pressure sensors 230,235,240 each produce signals responsive to the pressures of the respective hydraulic cylinders 140,145,150. For example, cylinder pressure sensors 230,235,240 sense boom, stick and bucket hydraulic cylinder head and rod end pressures, respectively. A suitable pressure sensor is provided by Precise Sensors, Inc. of Monrovia, Calif. in their Series 555 Pressure Transducer, for example.

A swing angle sensor 243, such as a rotary potentiometer, located at the work implement pivot point 180, produces an angle measurement corresponding to the amount of work implement rotation about the swing axis, Y, relative to the dig location.

The position and pressure signals are delivered to a signal conditioner 245. The signal conditioner 245 provides conventional signal excitation and filtering. The conditioned position and pressure signals are delivered to a logic means 250. The logic means 250 is a microprocessor based system which utilizes arithmetic units to control process according to software programs. Typically, the programs are stored in read-only memory, random-access memory or the like. The programs are discussed in relation to various flowcharts.

The logic means 250 includes inputs from two other sources: multiple joystick control levers 255 and an operator interface 260. The control levers 255 provide for manual control of the work implement 100. The control levers 255 produce operator control signals indicative of hydraulic cylinder 140,145,150,185 direction and velocity. The operator control signals are received by the logic means 250. The magnitude of the operator control signals are proportional to the amount of displacement or deflection of the respective operator control lever. Thus, the greater the deflection of a control lever, the greater the magnitude of the operator control signal, which in turn, is representative of a greater velocity of a respective hydraulic cylinder. Also, the polarity of a control signal indicates direction. For example, the control signals may have values ranging from −100% to +100%.

A machine operator may enter excavation specifications such as excavation depth and floor slope through an operator interface 260 device. The operator interface 260 may also display information relating to the excavating machine payload. The interface 260 device may include a liquid crystal display screen with an alphanumeric key pad. A touch sensitive screen implementation is also suitable. Further, the operator interface 260 may also include a plurality of dials and/or switches for the operator to make various excavating condition settings.

The logic means 250 receives the position signals and responsively determines the velocities of the boom 110, stick 115, bucket 120, and swing 185 using well known differentiation techniques. It will be apparent to those skilled in the art that separate velocity sensors may be equally employed to determine the velocities of the boom, stick, bucket and swing.

The logic means 250 may also determine the velocity of the boom, stick, bucket, and swing in response to determining the magnitude of the operator control signals.

The logic means 250 additionally determines the work implement geometry and forces in response to the position and pressure signal information.

For example, the logic means 250 receives the pressure signals and computes boom, stick, and bucket cylinder forces, according to the following formula:

$$\text{cylinder force}=(P_2*A_2)-(P_1*A_1)$$

where $P_2$ and $P_1$ are respective hydraulic pressures at the head and rod ends of a particular cylinder 140,145,150, and $A_2$ and $A_1$ are cross-sectional areas at the respective ends.

The logic means 250 produces boom, stick and bucket cylinder command signals for delivery to an actuating means 265 which controllably moves the work implement 100. The actuating means 265 includes hydraulic control valves 270, 275,280 that controls the hydraulic flow to the respective boom, stick and bucket hydraulic cylinders 140,145,150. The actuating means 265 also includes a hydraulic control valve 285 that controls the hydraulic flow to the swing assembly 185.

FIGS. 3–11 are flowcharts illustrating the program control of the present invention. The program depicted on the flowcharts is adapted to be utilized by any suitable microprocessor system.

The following description will refer to a plurality of control curves shown in FIGS. 13–16 that illustrate command signals that control the displacement of the boom, stick, and bucket cylinders 140,145,150 at desired velocities. The curves may be defined by two-dimensional look-up tables or a set of equations that are stored in the microprocessor memory. The controlling curve is responsive to a material condition setting that represents the condition of the ground soil. For example, at the extremes, material condition setting 1 represents a loose condition of the material, while material condition setting 9 represents a hard packed condition of the material. Thus, intermediate material conditions settings 2–8 represent a continuum of material conditions from a loose or soft material condition to a hard material condition. It will be understood by those skilled in the art that the number of the control curves are responsive to the desired characteristics of the control.

Further, the material condition setting may be set either by the operator via the operator interface 260, or by the logic means 250 in response to excavating conditions. For example, the material condition setting of the control curves pertaining to the dig-stroke function, FIGS. 15,16, may be manually set by the operator, while the remainder of the material condition settings associated with the other tables may be automatically set by the logic means 250. This allows for an experienced operator to have greater control of the work cycle.

Figure 3:
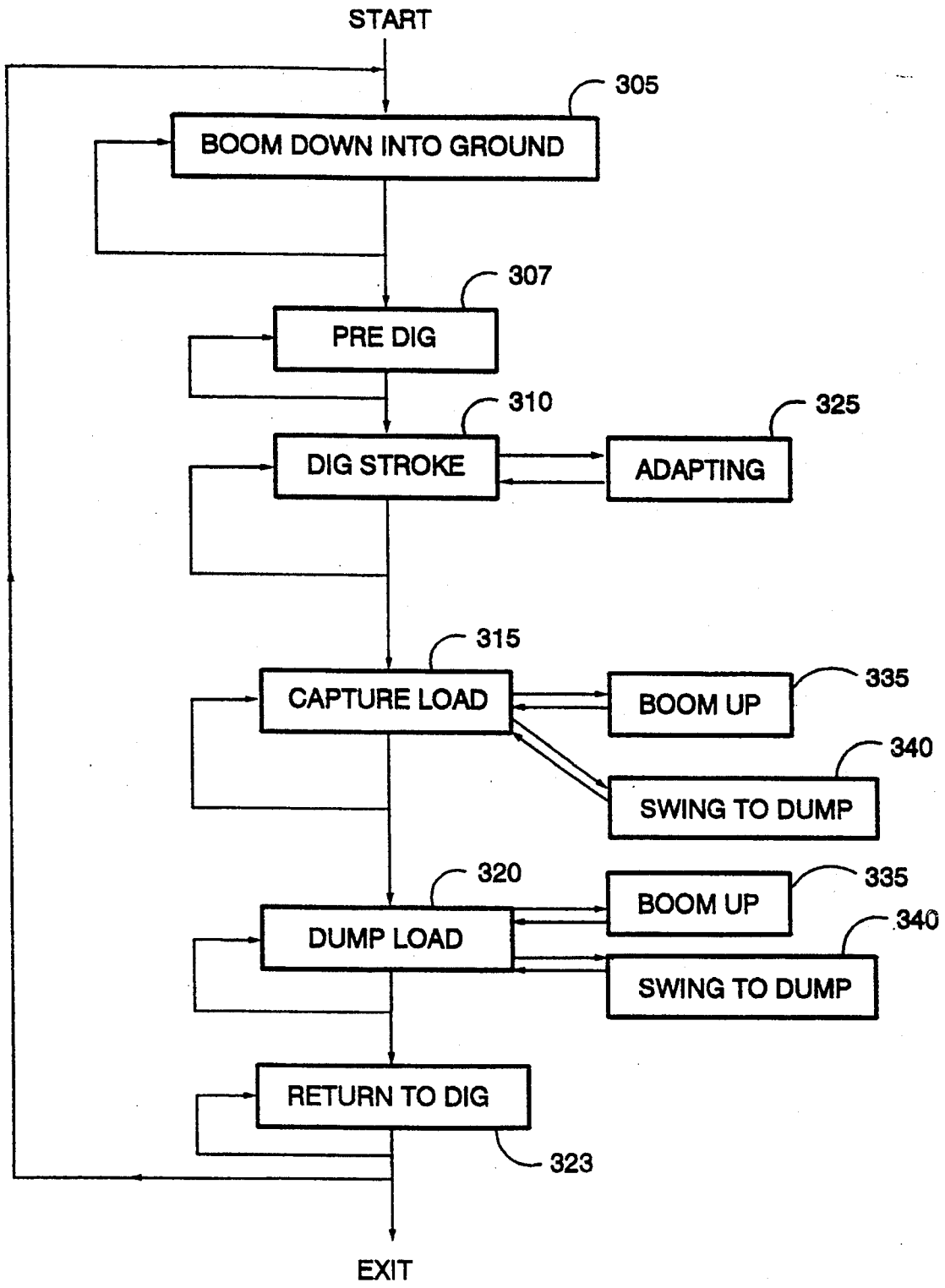
FIG. 3 is a top level flowchart of an embodiment of the present invention.

Referring now to FIG. 3, a top level flowchart of an automated excavation work cycle is shown. The work cycle for an excavating machine 105 can generally be partitioned into six distinctive and sequential functions: boom-down-into-ground 305, pre-dig 307, dig-stroke 310, capture-load 315, dump-load 320, and return-to-dig 323. The dig-stroke function 310 includes an adaptive function 325. The capture-load function 315 includes a boom-up function 335 and a swing-to-dump function 340. The dump-load function 320 also includes the boom-up, swing-to-dump functions. Each of the functions are discussed below.

As the flowchart shows, the automated excavation work cycle is iteratively performed. Operator intervention is not required to perform the work cycle, although the operator may modify the work implement 100 movement when the modification does not contradict maximum depth or restricted area specifications. Further, because the functions are discrete, the present invention allows for the functions to be performed independent of one another. For example, the operator may select, via the operator interface, predetermined ones of the functions to be automated during execution of the work cycle.

Figure 4:
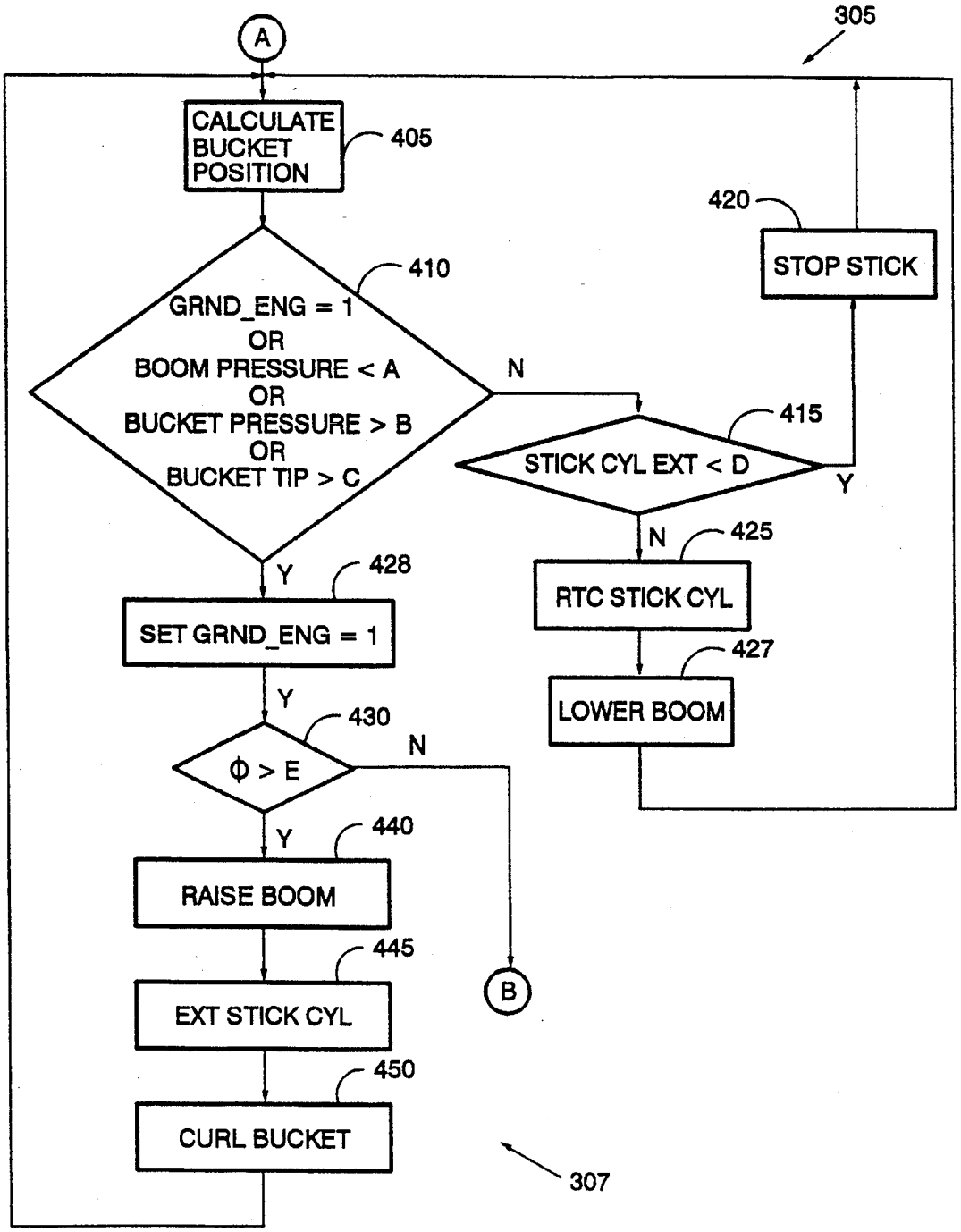
FIG. 4 is a second level flowchart of an embodiment of a boom-down-into-ground function.

In FIG. 4, the boom-down-into-ground function 305 is illustrated. The boom-down-into-ground function positions the work implement 100 toward the ground. The function begins by calculating the bucket position as shown by block 405. Hereafter the term "bucket position" refers to the bucket tip position, together with the bucket angle $\phi$, as shown in FIG. 1. The bucket position is calculated in response to the position signals. The bucket position may be calculated by various methods that are well known in the art.

In decision block 410, the program control first determines if a GRND_ENG is equal to one, which indicates that the work implement 100 has engaged the ground. If not, the program control compares the boom cylinder pressure to a setpoint A, and the bucket cylinder pressure to a setpoint B. Setpoints A and B represent boom and bucket cylinder pressures which indicate that the work implement 100 has engaged the ground. The bucket tip 15 depth is also compared to a setpoint C, which represents the maximum dig depth as specified by the operator.

If all the conditions of decision block 410 fail, control then proceeds to block 415 where the stick cylinder position, i.e. the amount of cylinder extension, is compared to a setpoint D. Setpoint D represents the minimum amount of stick cylinder extension that provides for a desired digging position. If the stick cylinder position is greater than or equal to setpoint D, then the stick cylinder 145, which was previously being retracted, is now gradually stopped at block 420. However, if the stick cylinder position is less than setpoint D, then the stick cylinder 145 is retracted by a predetermined amount to reach the stick outward, shown by block 425. After which , the boom 110 is lowered toward the ground at block 427. Thus, as long the boom and bucket cylinder pressures indicate that the work implement 100 has yet to engage the ground, and the bucket 120 has not exceeded the maximum depth, the boom 110 continues to be lowered toward the ground.

If one of the conditions of decision block 410 pass, then GRND_ENG is set to one at block 428. The program control then compares the bucket or cutting angle $\phi$ to a setpoint E at block 430. Setpoint E is a predetermined cutting angle of the bucket 120. Setpoint E may determined from the curve shown on FIG. 12, where the predetermined cutting angle is responsive to the material condition setting.

If the bucket angle $\phi$ is greater than setpoint E, the bucket 120 is then curled at maximum velocity to quickly position the bucket at the predetermined cutting angle by the pre-dig function 307. For example, the pre-dig function 307 positions the work implement 100 at a desired starting position.

Next, at blocks 440,445,450, the boom 110 is raised, the stick 115 is brought toward the machine, and the bucket is curled by extending the respective cylinders 140,145,150. The command level corresponding to the boom cylinder 140 is shown on FIG. 13, where the command level is responsive to the pressure or force imposed on the bucket cylinder 150. The controlling curve is responsive to the material condition setting. The command level corresponding to the stick cylinder 145 is shown on FIG. 14, where the command level is responsive to the pressure or force imposed on the stick cylinder 145. Here, one curve satisfies all material condition settings. The bucket 120 is curled at nearly maximum velocity to quickly position the bucket at the predetermined cutting angle. It is apparent from the foregoing that during the pre-dig function, the work implement 100 is positioned to adjust the bucket depth and the cutting angle $\phi$ to be ready for digging.

Figure 5:
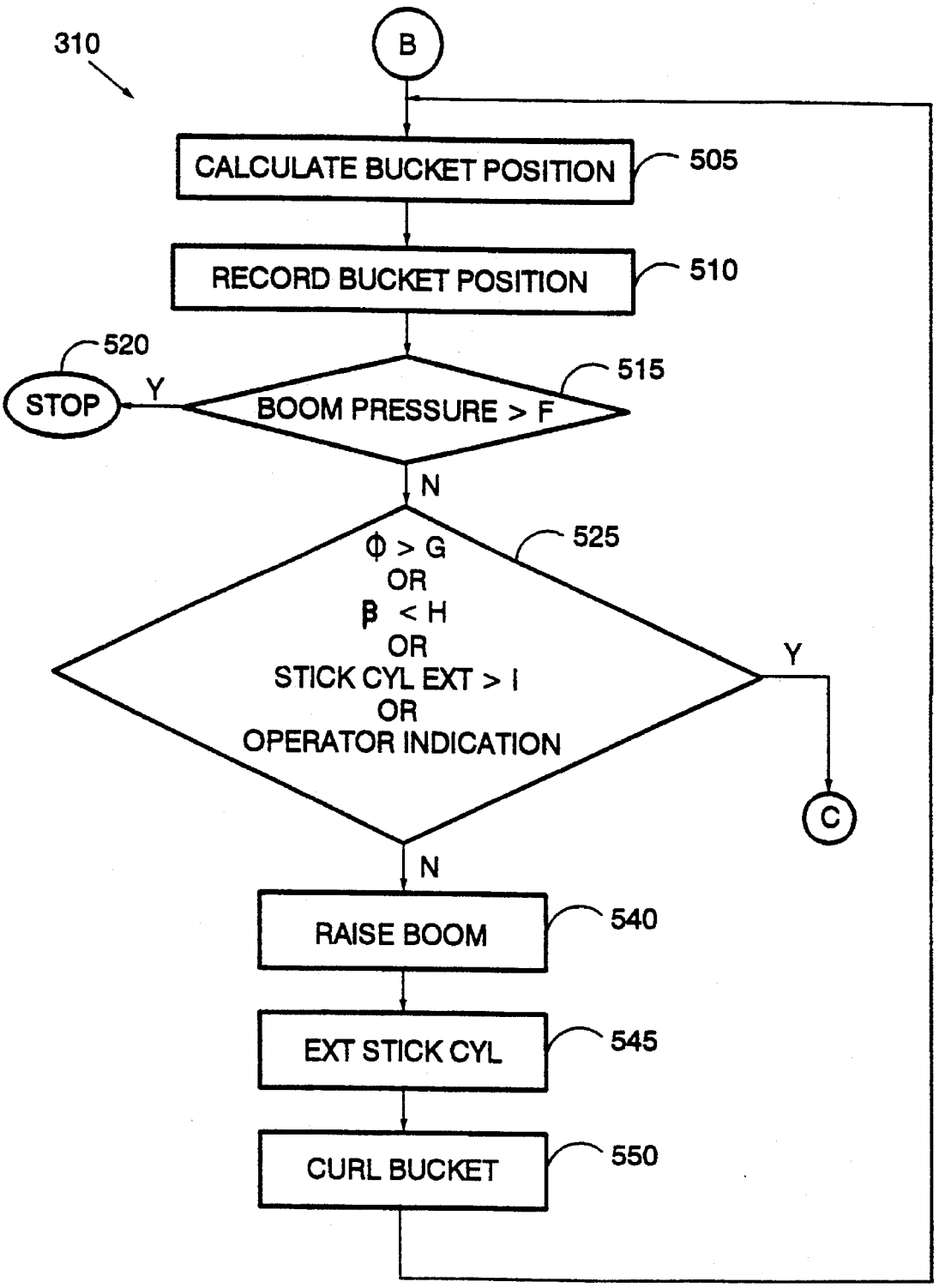
FIG. 5 is a second level flowchart of an embodiment of a dig-stroke function.

If, however, the bucket angle $\phi$ is less than or equal to the setpoint E, then program control proceeds to section B of the flowchart to initiate the dig-stroke function 310 (FIG. 5).

The dig-stroke function 310 moves the bucket 120 along the ground toward the excavating machine 105. The dig-stroke function begins by calculating the bucket position at block 505. For example, as the digging cycle continues, the bucket 120 may extend deeper into the ground. Consequently, the control records the position of the bucket 120 as it extends deeper into the ground at block 510. In decision block 515, the boom cylinder pressure is compared to a setpoint F. If the boom cylinder pressure exceeds setpoint F, the machine is said to be unstable and may tip. Accordingly, if the boom cylinder pressure exceeds setpoint F, then program control stops as shown by block 520. Otherwise, control continues to decision block 525. Note that, the value of setpoint F may be obtained from a table of pressure values that correspond to a plurality of values representing excavator instability for various geometries of the work implement 100.

The excavating machine 105 performs the digstroke or digging portion of the work cycle by bringing the bucket 120 toward the excavating machine. Decisional block 525 indicates when the dig-stroke is complete. First, the bucket angle $\phi$ is compared to a setpoint G, which represents a predetermined bucket curl associated with a desired amount of bucket fill. Second, the angle of the bucket force, $\beta$ is compared to a setpoint H. For example, setpoint H represents an angular value that is typically zero. If, for example, $\beta$ is lesser than setpoint H, then the bucket is said to be heeling. Heeling occurs when the net force on the bucket is imposed on the underside of the bucket, which indicates that no more material may be captured by the bucket. For a more thorough discussion of bucket heeling, reference is made to Applicant's co-pending application entitled "System And Method For Determining The Completion Of A Digging Portion Of An Excavation Work Cycle" (Arty. Docket No. 93-326), which was filed on the same day as the present application and is hereby incorporated by reference. Third, the stick cylinder position is compared to a setpoint I, which indicates dig-stroke completion. Setpoint I represents a maximum stick cylinder extension for digging. Finally, the program control determines if the operator has indicated that digging should cease, via the operator interface 260, for example. If any one of these conditions occur, then program control proceeds to section C of the flowchart where the machine 105 finishes digging and commences capturing the load.

If it is shown that digging is not complete, then, at blocks 440,445,450, the boom 110 is raised, the stick 115 is brought toward the machine, and the bucket is curled by extending the respective cylinders 140,145,150.

Figure 15:
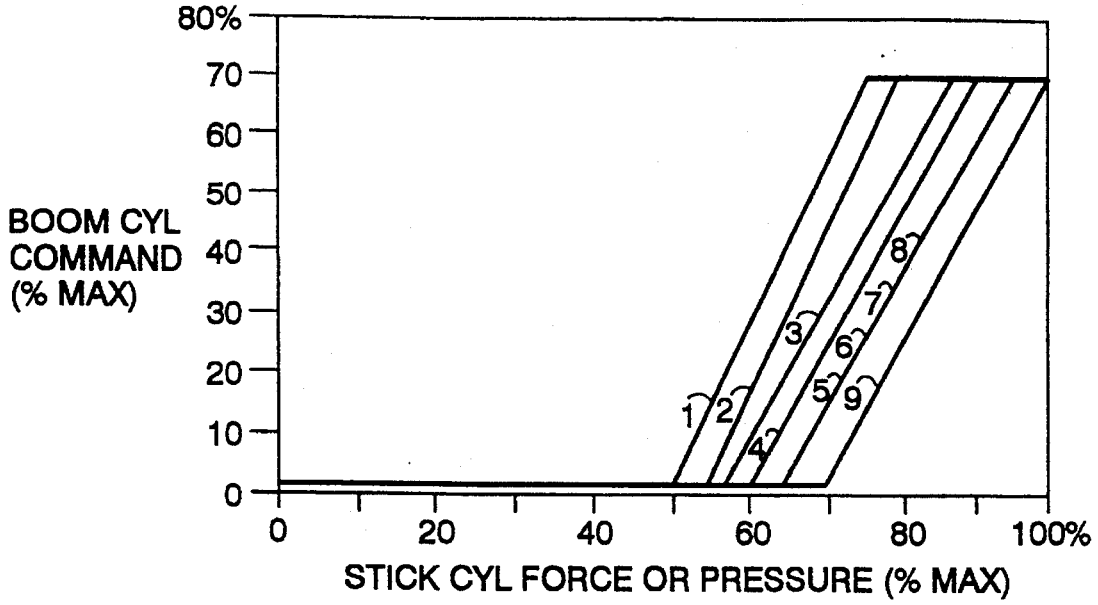
FIG. 15 is a table representing control curves pertaining to a boom cylinder command during the dig-stroke function.
Figure 16:
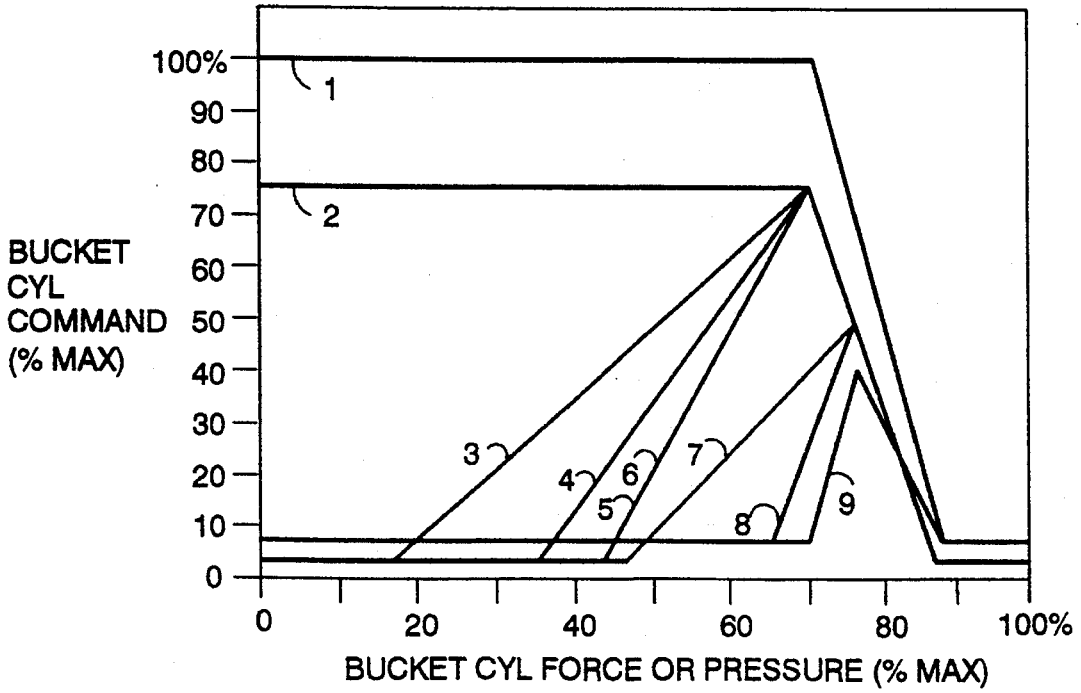
FIG. 16 is a table representing control curves pertaining to a bucket cylinder command during the dig-stroke function.

The command level corresponding to the boom cylinder 140 is shown on FIG. 15, where the command level is responsive to the pressure or force imposed on the stick cylinder 155. The controlling curve is responsive to the material condition setting. The stick cylinder 145 is extended at nearly 100% of maximum velocity to quickly bring the stick 115 toward the machine. The bucket 120 is curled at a velocity dictated by the curves shown in FIG. 17, where the command level is responsive to the bucket cylinder pressure or force. As represented by the shape of the curves, the greater the material condition setting, the more percentage of the work will be performed by the stick 115, as compared to the bucket 120. Note, the curves of FIG. 16 "taper-off" to prevent the hydraulic system from being overloaded.

Figure 6:
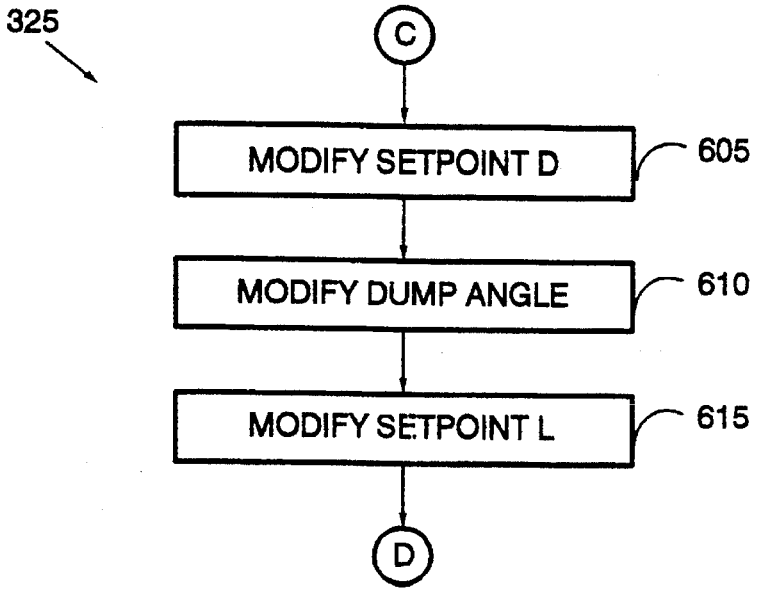
FIG. 6 is a second level flowchart of an embodiment of an adapting function.

At point C, program control proceeds to FIG. 6 to initiate the adapting function 325. The adapting function modifies setpoints during the excavating cycle to provide for efficient excavating. At block 605, setpoint D (the desired amount of stick cylinder extension prior to digging) is incremented by a predetermined amount in response to the last recorded depth of the bucket 120. For example, to provide for efficient digging, it is desirable to incrementally extend the stick outwardly as the bucket digs deeper into the ground.

At block 610, the dump angle is incremented by a predetermined amount in response to the last recorded bucket depth. For example, as the bucket digs deeper into the ground, the greater aggregate amount of material will be extracted from the ground. Consequently, the pile produced from dumping the material from the bucket onto the ground surface will "grow" with each pass. Accordingly, it is desirable to increment the dump angle as the bucket digs deeper so that the dump pile does not "fall" back into the hole. The dump angle is defined as the desired amount of angular rotation of the work implement from the dig location to a desired dump location. The dump angle is later discussed with reference to the swing-to-dump function 340.

Finally, at block 615 a setpoint L, which represents a desired boom cylinder extension that corresponds to a desired boom height for dumping, is incremented in response to the last recorded position bucket depth. For example, as the dumping pile gets larger, the boom height is incremented during each pass to make certain that the bucket clears the pile. The setpoint L is later described with reference to the boom-up function 335.

Figure 7:
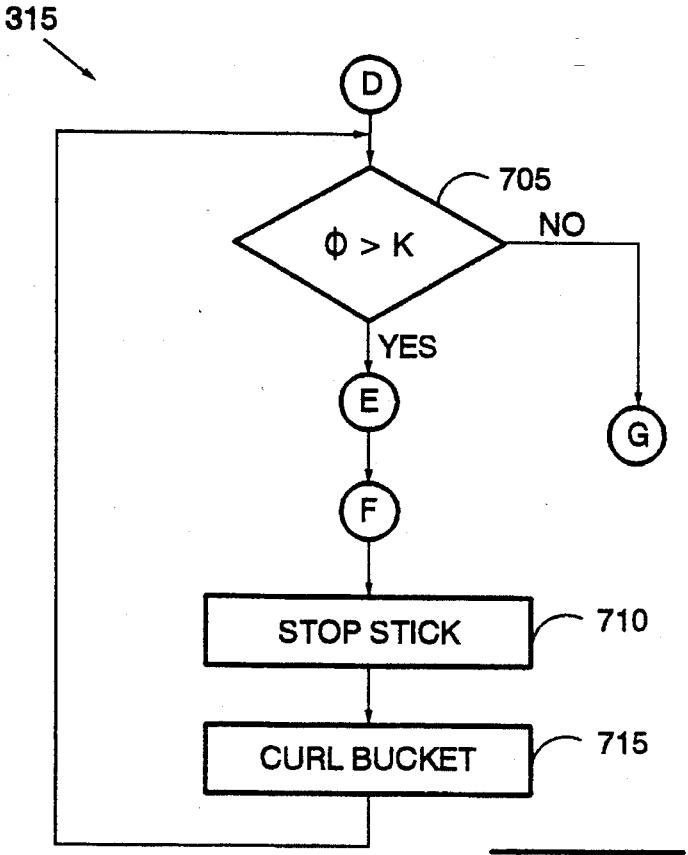
FIG. 7 is a second level flowchart of an embodiment of a capture-load function.
Figure 17:
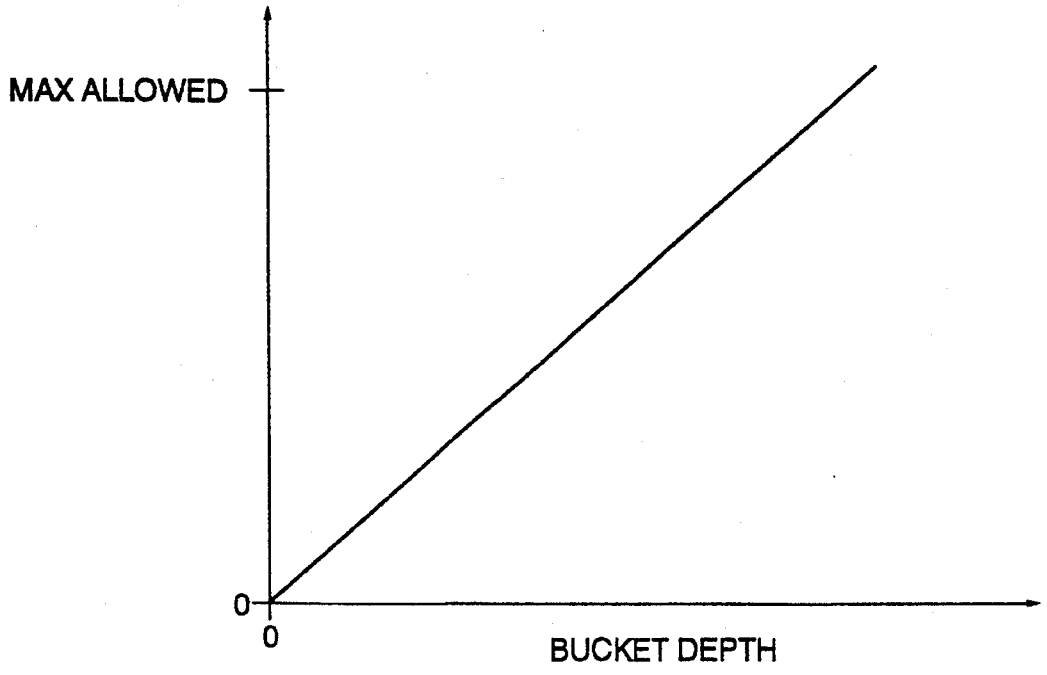
FIG. 17 is a table representing a control curve pertaining to the adapting function.
Figure 13:
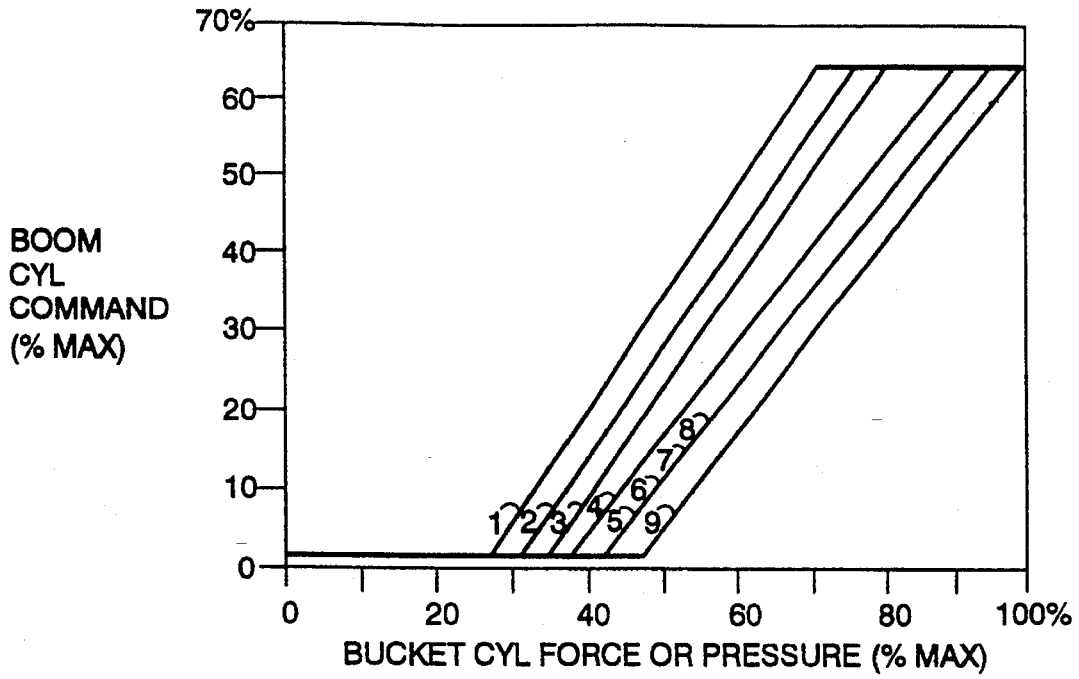
FIG. 13 is a table representing control curves pertaining to a boom cylinder command during a predig function.
Figure 14:
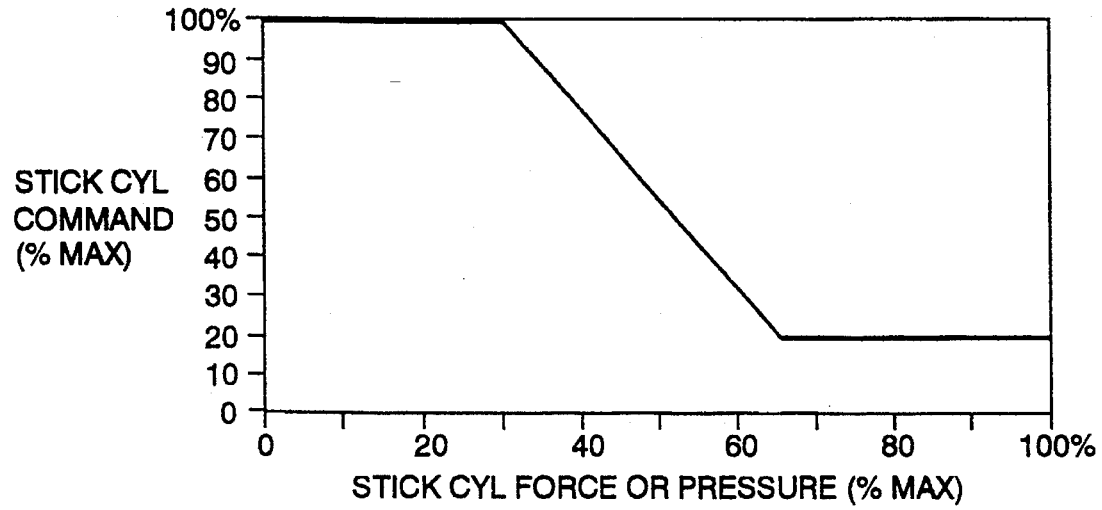
FIG. 14 is a table representing control curves pertaining to a stick cylinder command during the predig function.

The adapting function may increment the values in a linear relationship, according to the curve shown in FIG. 17. Once the modifications are made, then program control proceeds to point D to initiate the capture-load function 315 (FIG. 7).

The capture-load function 315 positions the work implement 100 in order to "capture" the load. The capture-load function 315 begins by comparing the bucket angle, $\phi$, to a setpoint K at block 705. Setpoint K represents a bucket angle sufficient to maintain a heaped bucket load. If the present bucket angle, $\phi$, is less than the setpoint K, then control continues to point E to call the boom-up function 335. The boom-up function 335 will be described later. Control then continues to section F to call the swing-to-dump function 340. The swing-to-dump function 340 will also be described later. Consequently, the stick cylinder 145, which was previously being extended, is now gradually stopped at block 710. The bucket 120 is then curled at block 715. It is apparent that the bucket will continuously be curled until the bucket angle, $\phi$, is greater than the setpoint K. Consequently, control proceeds to section G to call the dump-load function 320, which is described later.

Figure 8:
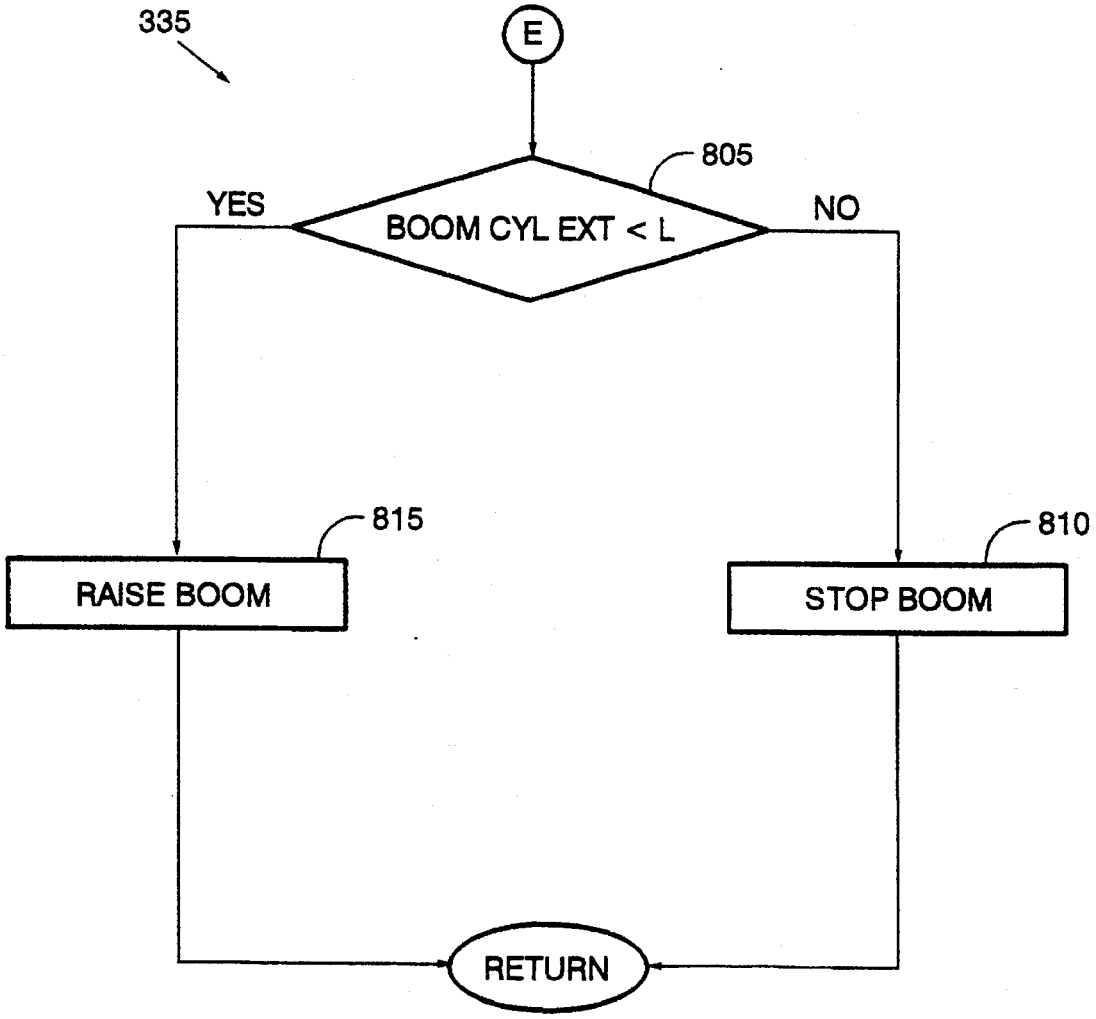
FIG. 8 is a second level flowchart of an embodiment of a boom-up function.

The boom-up function 335 is now described with reference to FIG. 8. The boom-up function begins by determining if the boom cylinder extension is less than the setpoint L at block 805. As earlier stated, setpoint L represents the boom cylinder extension sufficient to cause the work implement 100 to clear the dump pile. If the boom cylinder extension is not less than the setpoint L, then the boom cylinder extension is gradually stopped at block 810. Otherwise the boom cylinder 140 is extended at a predetermined velocity, typically 100% of maximum velocity, to quickly raise the boom. The program control then returns to the function that previously called the boom-up function 335.

Figure 9:
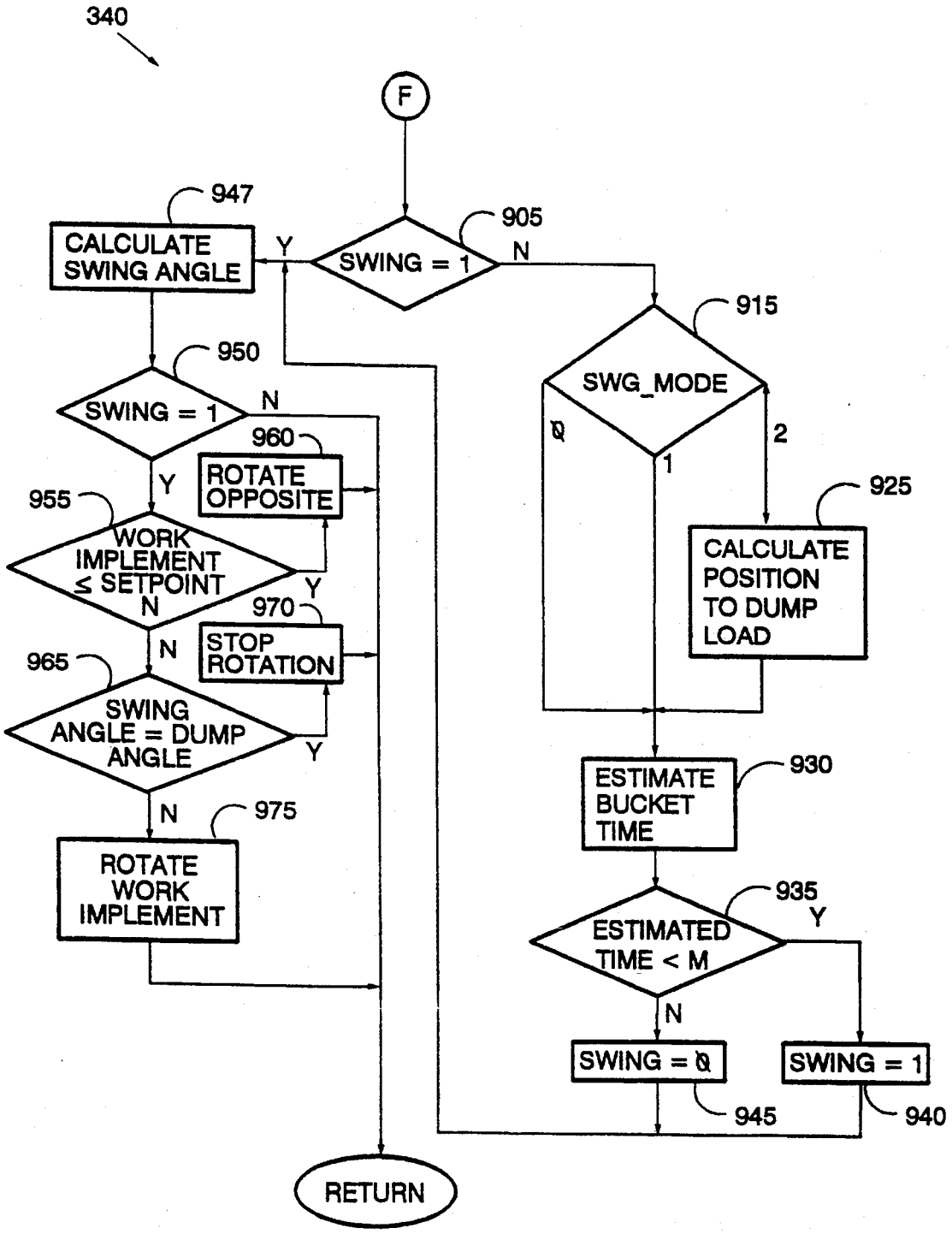
FIG. 9 is a second level flowchart of an embodiment of a swing-to-dump function.

The swing-to-dump function 340 is now described with reference to FIG. 9. It should be noted that prior to starting the excavation work cycle, the dump and dig locations and their respective transverse angles may be specified and recorded. For example, a dig angle may be set by positioning the work implement 100 at a desired dig location. Similarly, a dump angle may be set by swinging or rotating the work implement 100 to a desired dump location. The desired dump and dig angles are then stored by the control system. Alternatively, the operator may enter the desired transverse angles corresponding to the dig and dump angle into the operator interface.

The swing-to-dump function 340 first determines if SWING is set to one at block 905. If SWING is set to zero, then the program proceeds to block 915 to determine the value of a variable SWG_MODE. The variable SWG_MODE is set by the operator and represents the type of excavation. For example, a SWG_MODE of zero represents that the machine is side-casting from a trench or hole. A SWG_MODE of one represents that the machine is dumping to a single point, such as a hauling truck for example. The operator then enters the height of the truck bed relative to a horizontal plane extending from the bottom portion of the tracks via the operator interface 250. A SWG_MODE of two represents that the machine is side-casting from a mass excavation location. At block 925, the control calculates the position of the work implement in order to dump the load at the desired dump location.

Figure 18:
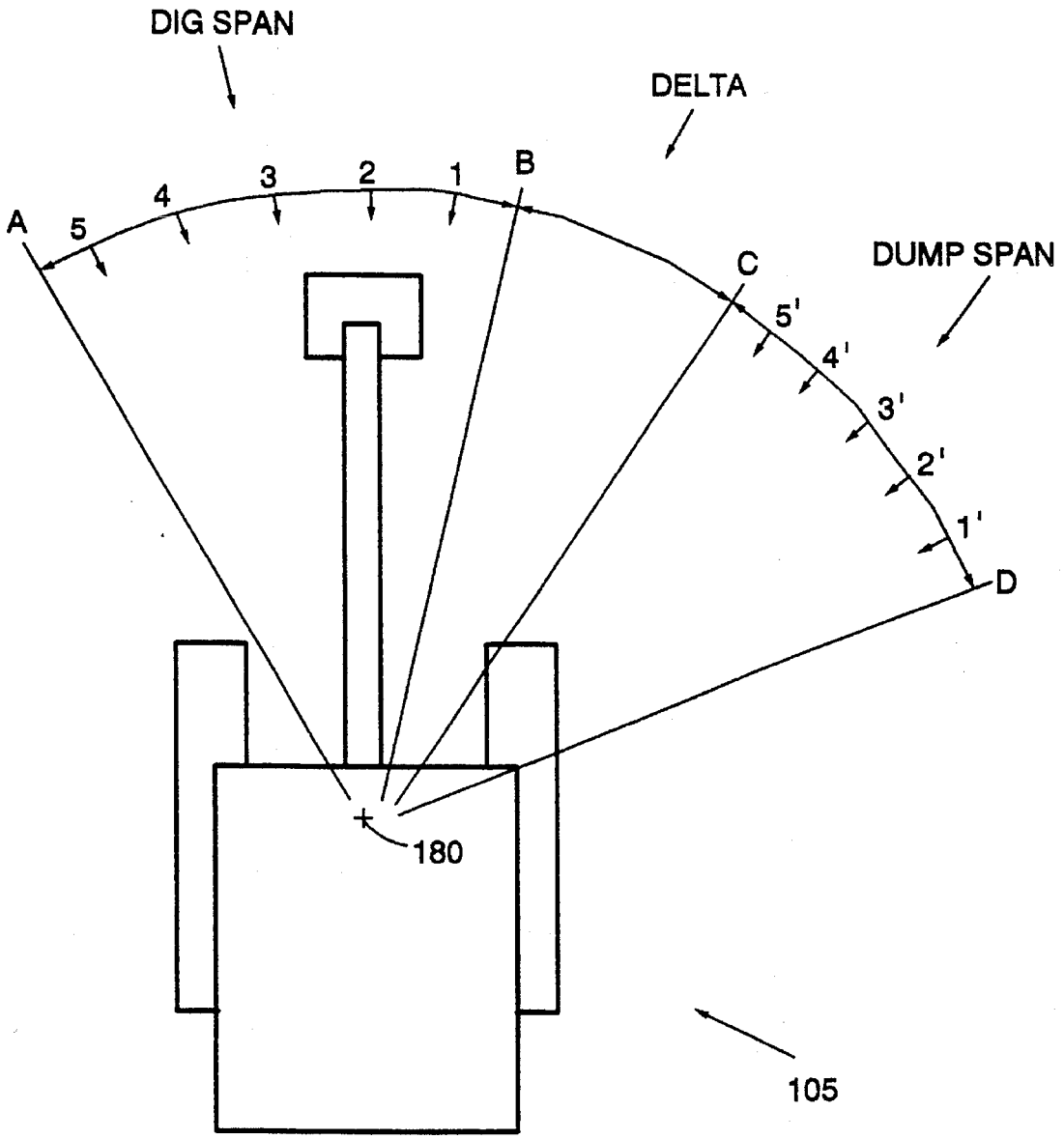
FIG. 18 is a top view of the excavating machine that is side casting.

If SWG_MODE is set to two, control then proceeds to block 925 where the dump angle is modified in response to the span of the excavation. For a better understanding, reference is now made to FIG. 18, which illustrates a top view of a machine that is mass excavating. First, the operator enters angular values for a dig span, dump span, and delta value, β. Next, the control "maps" the dig span and dump span into respective dig and dump paths. Thus, the machine will dig-stroke at path "1" and dump at path "1'", for example. After each pass, the control modifies the dump angle, according to:

$$\text{dump angle} = \frac{\text{position}}{C} - \text{dump span} + \left[\frac{\text{dig position} - \left(\frac{\text{position}}{C} + \delta\right)}{\text{dig span}} * \text{dump span}\right] - \text{dig position}$$

Thus, once the machine completes path "1", the control may then increment the dig location to begin digging at path "2". Alternately, the control may allow for operator assistance to position the work implement at path "2", once digging is complete at path "1". In the alternate example, the control would then remember the last dig location that the operator selected. Accordingly, the control would "relax" any tolerances associated with the dig location so that the operator may position the work implement from the current dig location to a new dig location.

Referring back to FIG. 9, control proceeds to block 930, where the time for the bucket 120 to reach the ground surface is estimated. The estimated time is calculated in response to the bucket position and velocity. Once the estimated time is calculated, then the estimated time is compared to a setpoint M. Setpoint M represents a time lag of the electrohydraulic swing system. If the estimated time is less than setpoint M, then SWING is set to one at block 940. However, if the estimated time is not less than setpoint M, then SWING is set to zero at block 945.

Program control then proceeds to block 947 to calculate the swing angle. The swing angle is defined as the amount of angular rotation of the work implement relative to the dig location. The swing angle sensor 243 produces an angle measurement corresponding to the amount of work implement rotation relative to the dig location. At block 950, the program determines if SWING is set to one. If SWING is set to zero, then control returns to the function that previously called the swing-to-dump function 340.

However, if SWING is set to one, then control proceeds to block 955 where the calculated position of the work implement 100 is compared to a setpoint N. Setpoint N represents a predetermined range of work implement positions from the desired dump position. If the calculated work implement position is within the range associated with setpoint N, then the work implement 100 is near the dump position. Thus, the work implement 100, which is currently being rotated toward the dump location, is now commanded to rotate in the opposite direction, back toward the dig location (block 960). For example, because the work implement 100 is near the dump position, the work implement is "back-driven" toward the dig location to account for any "lag" in the electrohydraulic swing system. Thus, by the time the work implement actually begins rotating in the opposite direction, the work implement will have already reached the dump position.

If the work implement 100 has yet to reach the range defined by setpoint N, then the swing angle is compared to the dump angle, at block 965. If the swing angle is equal to the dump angle, then the work implement has reached the desired dump location. Thus, the rotation of the work implement 100 is stopped at block 970. Otherwise the work implement is rotated at 100% of maximum velocity to quickly rotate the work implement toward the dump location at block 975. Program control then returns to the function that previously called the swing-to-dump function 340.

Figure 10:
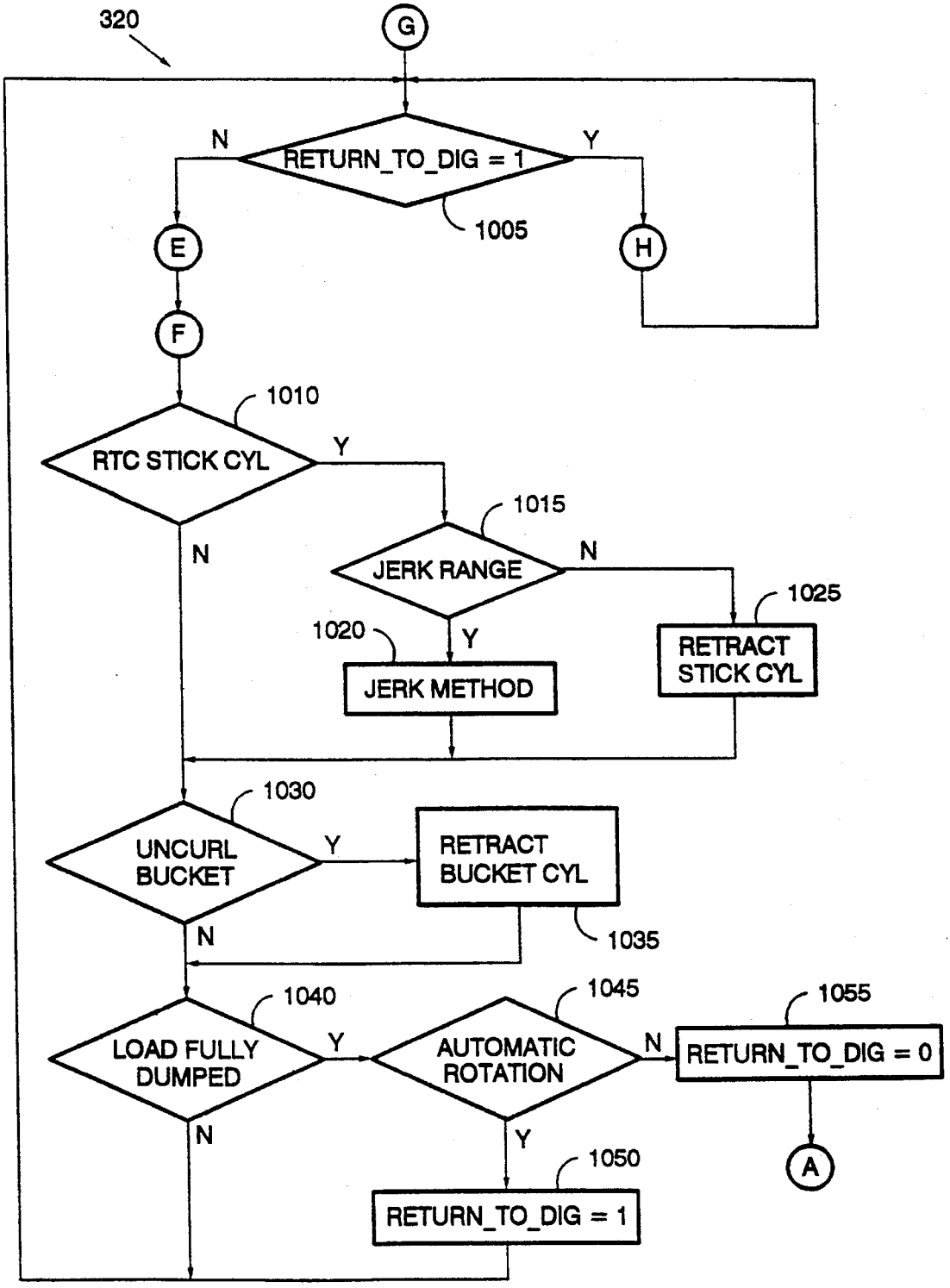
FIG. 10 is a second level flowchart of an embodiment of a dump-load function.
Figure 11:
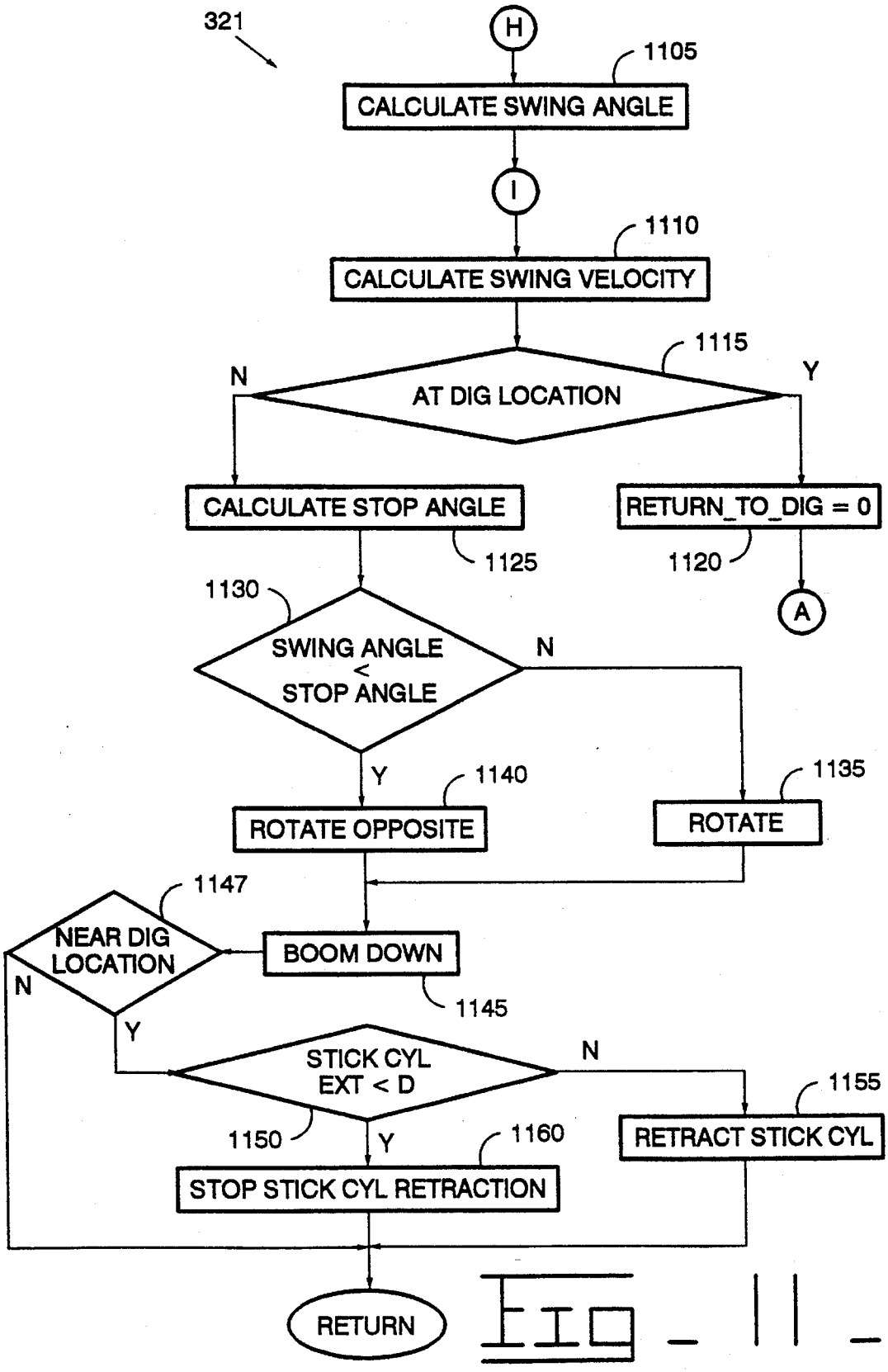
FIG. 11 is a second level flowchart of an embodiment of a return-to-dig function.

Referring now to FIG. 10, the dump-load function 320 is described. Control begins at decision block 1005 where the program determines if RETURN_TO_DIG is equal to one. If RETURN_TO_DIG is equal to zero, then the machine is to continue dumping the load. Accordingly, control proceeds to section E to call the boom-up function 335, then to section F to call the swing-to-dump function 340.

Control then proceeds to decision block 1010 to determine if the stick cylinder 145 should be retracted to extend the stick 115 further outward from the machine. This decision is based on three criteria:

(1) Is the swing angle within a predetermined range of the dump angle?; and (2) Is the boom cylinder position greater than a setpoint O?; and (3) Is the stick cylinder position greater than setpoint P? where, setpoint 0 represents a boom cylinder position at which the stick cylinder should begin retracting for dumping. Typically, the value of setpoint O represents a predetermined amount of a boom cylinder extension less than the boom cylinder extension represented by setpoint L. Setpoint P represents the final stick cylinder position for dumping.

If all of these conditions pass, then control proceeds to block 1015, which represents a "jerking" feature. For example, if the operator selects a material condition setting representing moist material, then it may be desirable to "jerk" or "shake" the stick 115 while the load is being dumped, to release the moist material from the bucket 120. If the stick cylinder extension is found to be within a range desirable to jerk the stick 115, then the stick cylinder 145 is jerked at block 1020. However, if the stick is not within a range desirable for jerking, then the stick cylinder is retracted by a predetermined amount at a constant velocity at block 1025.

Control then continues to block 1030 to determine if the bucket cylinder 150 should be retracted to uncurl the bucket 120. The decision of block 1030 depends on four criteria:

(1) Is the swing angle within a predetermined range of the dump angle?; and (2) Is the boom cylinder position greater than setpoint L?; and (3) Is the stick cylinder position greater than setpoint Q?; and (4) Is the bucket cylinder position greater than setpoint R?

where, setpoint Q represents the stick cylinder position at which the bucket 120 should begin to uncurl during dumping. Typically, the value of setpoint Q is a predetermined value greater than setpoint P. Setpoint R is the final bucket cylinder position for dumping.

Figure 12:
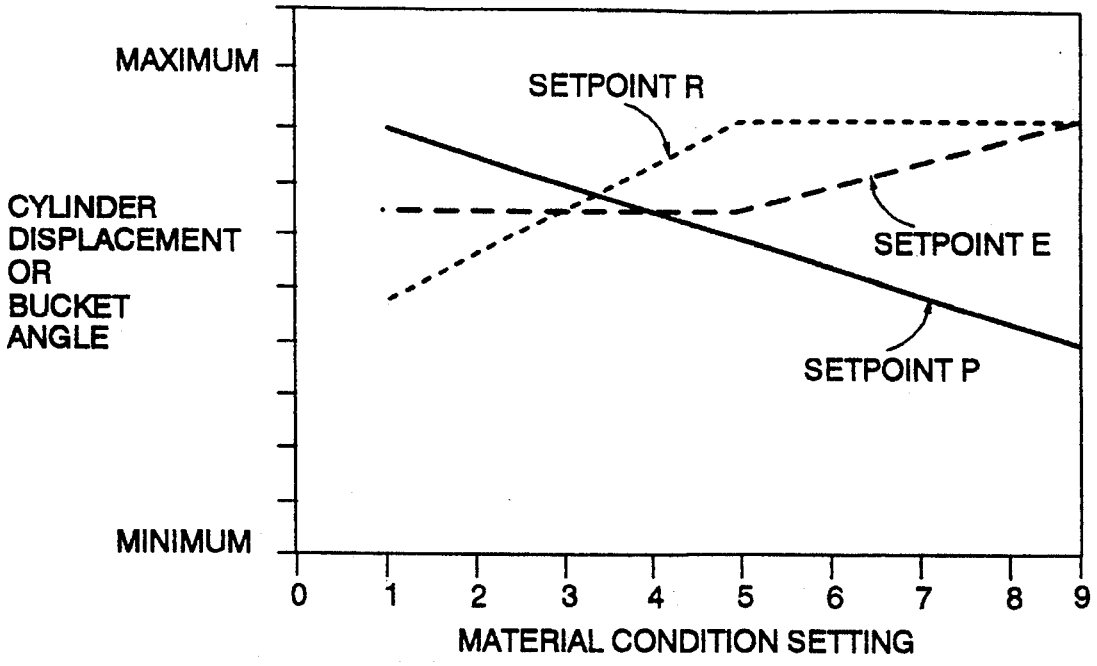
FIG. 12 is a table representing various setpoint values.

Both setpoints P and R are determined from the respective curves according to FIG. 12. As shown, the actual value of the setpoints are responsive to the material condition setting. This provides for the respective stick reach and bucket curl to be at optimum positions once the dumping is complete and the digging begins. For example, loose material conditions require that the stick cylinder extension be relatively short because the bucket 120 is easily filled during a digging pass. However, as the material becomes harder, a long stroke is desired because material penetration is difficult; thus, a longer stroke is required to fill the bucket 120.

If all of the conditions of block 1030 occur, then control proceeds to block 1035 to retract the bucket cylinder 150. Otherwise control continues to block 1040 to determine if the load is fully dumped. At block 1040, the boom, stick, and bucket cylinder positions are compared to setpoints L, Q, and R respectively to determine whether the captured load has been fully dumped. If the cylinder positions are within a predetermined range of the respective setpoints then the load is said to be fully dumped, i.e., the boom 110 is raised, the stick 115 is extended outward, and the bucket 120 is inverted. Otherwise control returns to block 1005 to complete the dumping cycle.

However, when the load is dumped, control proceeds to block 1045 where the program determines if the operator desires to use automatic rotation. The operator may indicate so via the operator interface 260. If automatic rotation is to occur, then RETURN_TO_DIG is set to one at block 1050 and control returns to block 1005. Otherwise, RETURN_TO_DIG is set to zero and program control returns to the boom-down-into-ground function 305 in section A to continue cycling.

Adverting back to block 1005, if RETURN_TO_DIG is equal to one, then the captured load has been dumped and the work implement 100 is brought back to the digging location. Accordingly, control proceeds to section H to perform the return-to-dig function 323, which is discussed with reference to FIG. 11.

Control begins at block 1105 to calculate the swing angle. Control then proceeds to section I to perform the tuning function 330, which is described later.

Accordingly, control proceeds to block 1110 to calculate the swing velocity, e.g., the rotational velocity of the work implement 100 may be calculated by numerically differentiating the swing angle. The control then determines if the rotational position of the work implement 100 is within a predetermined range of the dig location, and the rotational velocity of the work implement 100 is less than a predetermined value (block 1115). For example, the swing angle is compared to the dig angle and the swing velocity is compared to a setpoint S, which represents a relatively slow rotational velocity. If the work implement 100 is within a predetermined range of the dig location and the rotational velocity is relatively slow, then the work implement resumes digging commencing with the boom-down-into-ground function 305 at section A. Consequently, RETURN_TO_DIG will be set to zero at block 1120.

However, if the work implement 100 is not within a predetermined range of the dig location, then a stop angle is calculated at block 1125. The stop angle is the angle at which the electrohydraulic drive assembly should stop rotating the work implement toward the dig location. The stop angle is responsive to the swing velocity and is calculated to account for the momentum of the rotating work implement. Once the stop angle is calculated, control then proceeds to block 1130 to compare the swing angle to the stop angle. If the swing angle is not less than the stop angle, then at block 1135, the electrohydraulic drive assembly continues to rotate the work implement toward the dig location. However, if the swing angle is less than the stop angle, then at block 1140, the electrohydraulic drive assembly rotates the work implement in the opposite direction to quickly stop its rotation.

The boom is lowered into the ground at block 1145. Then, the swing angle is compared to the dig location at block 1147. If the swing angle is within a predetermined range of the dig location, then control proceeds to block 1150. At block 1150, the stick cylinder position is compared to setpoint D to determine if the stick 115 has a proper reach. If the stick cylinder position is not less than setpoint D, then the stick cylinder 145 is retracted by a predetermined amount at block 1155 to increase the outward reach of the stick 115; otherwise the retraction of the stick cylinder 145 is gradually stopped at block 1160.

The following discussion pertains to a discussion of a learn function 1900, which is a method whereby the logic means 250 "learns" the working envelope of the excavation work cycle as defined by the operator to result in automatic control of the work cycle. For example, the working envelope is defined by predetermined setpoints of the excavating work cycle. Further the logic means continually adapts the work cycle to changes in the work environment as the excavator performs the work cycle. More particularly, the logic means 250 receives the position and pressure signals, determines predetermined operating parameters associated with predetermined portions of the work cycle, and produces a command signal to the actuating means 265 to automatically perform the work cycle.

Figure 19A:
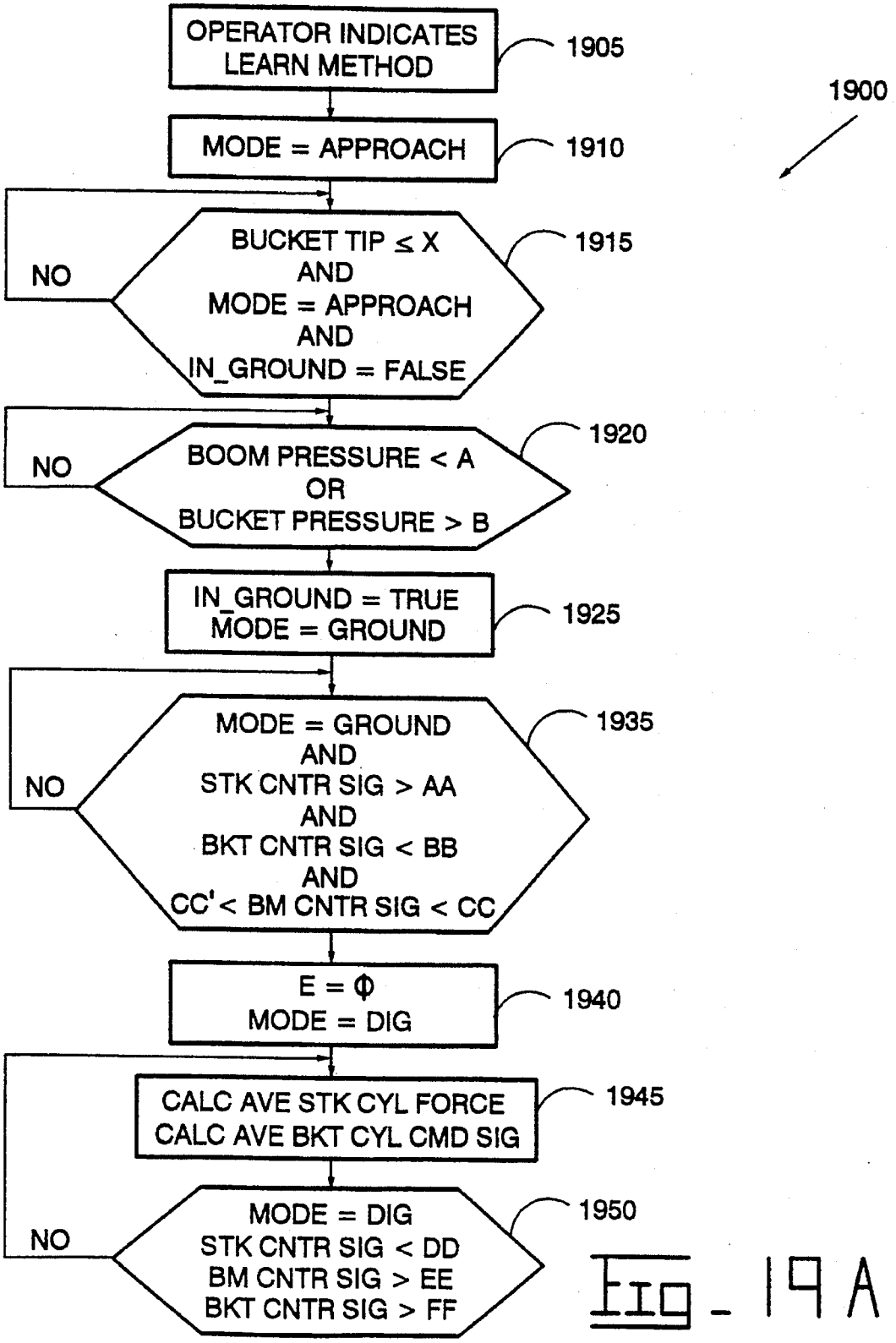
FIGS. 19 A,B are second level flowcharts of an embodiment of a learn function.

Reference is now made to FIGS. 19 A,B which show a flowchart of the program control of the learn function 1900. It is noted that at each decisional block of FIGS. 19A, B the program control may calculate the bucket position, and the pressures and forces in the respective hydraulic cylinders 140,145,150. The bucket position refers to the bucket tip position, together with the bucket angle $\phi$. The bucket position is calculated in response to the position signals in a manner well known in the art. For this discussion, assume that the following setpoints have a positive value, unless stated otherwise.

At block 1905, of FIG. 19A, the operator initiates the learn function by depressing a foot switch or the like. Consequently, a variable MODE is set to APPROACH at block 1910, which indicates that the bucket 120 is approaching the ground. At this time, the operator begins one complete work cycle. Program control continues to block 1915 to determine if the bucket position is below the excavator tracks by comparing the bucket position to a reference line, X, which is a line of reference extending from the bottom of the excavator tracks. If bucket position is found to be below the track level and the other conditions of decision block 1915 occur, then the program control proceeds to block 1920 to determine if the bucket 120 has engaged the ground.

At block 1920, the control compares the boom cylinder pressure to a setpoint A, and the bucket cylinder pressure to a setpoint B. Setpoints A and B represent boom and bucket cylinder pressures which indicate that the work implement 100 has engaged the ground. Once the control determines that the bucket 120 has engaged the ground, then a flag IN_GROUND is set to TRUE and the variable MODE is set to GROUND at block 1925.

Accordingly, the control proceeds to block 1935 to determine when the operator is beginning the dig-stroke portion of the work cycle by monitoring the operator control signals.

First, the program control compares the operator control signal associated with the movement of the stick cylinder 145 to a setpoint AA, which represents a control signal magnitude corresponding to a predetermined stick velocity. The control also compares the operator control signals associated with movement of the bucket and boom cylinders 150,140 to setpoints BB, and CC, CC', respectively. Setpoints BB, and CC,CC' represent operator control signal magnitudes corresponding to predetermined bucket 120 and boom 110 velocities. Note, CC' may have a negative value which represents a downward direction. The result of these comparisons indicates that the operator is quickly bringing the stick 115 toward the machine 105 while keeping the boom movement somewhat minimal. The bucket curl velocity is also monitored to determine if the bucket angle is ready for digging.

Once the conditions of block 1935 are satisfied, then the control assigns the value of a setpoint E to the angle of the bucket $\phi$, and the variable MODE to DIG at block 1940. Setpoint E represents the cutting angle of the bucket 120 at the start of digging. The control also determines the swing angle, which is associated with the dig location.

Program control then proceeds to block 1945, where the control determines the average force applied to the stick cylinder 145 and the average of the command signal magnitudes associated with the bucket cylinder 150 while the work implement is digging. For example, the average bucket command signal magnitude may correspond to the average velocity of the bucket.

Program control continues to decision block 1950 to determine if the digging or dig-stroke portion of the work cycle is complete by determining if the operator has commanded the work implement 100 to boom-up. As shown the control compares the operator control signal associated with the stick cylinder 145 to setpoint DD, which represents an operator control signal magnitude corresponding to a predetermined stick cylinder 145 velocity. The control additionally compares the operator control signal associated with the boom cylinder 140 to setpoint EE, which represents an operator control signal magnitude corresponding to a predetermined boom cylinder 140 velocity. Finally, the control compares the operator control signal associated with the bucket cylinder 150 to setpoint FF, which represents an operator control signal magnitude corresponding to a predetermined bucket cylinder 150 velocity. The result of these comparisons indicates that the boom is quickly being raised, the bucket 120 is being curled to capture the load, while the stick movement is minimal.

Figure 19B:
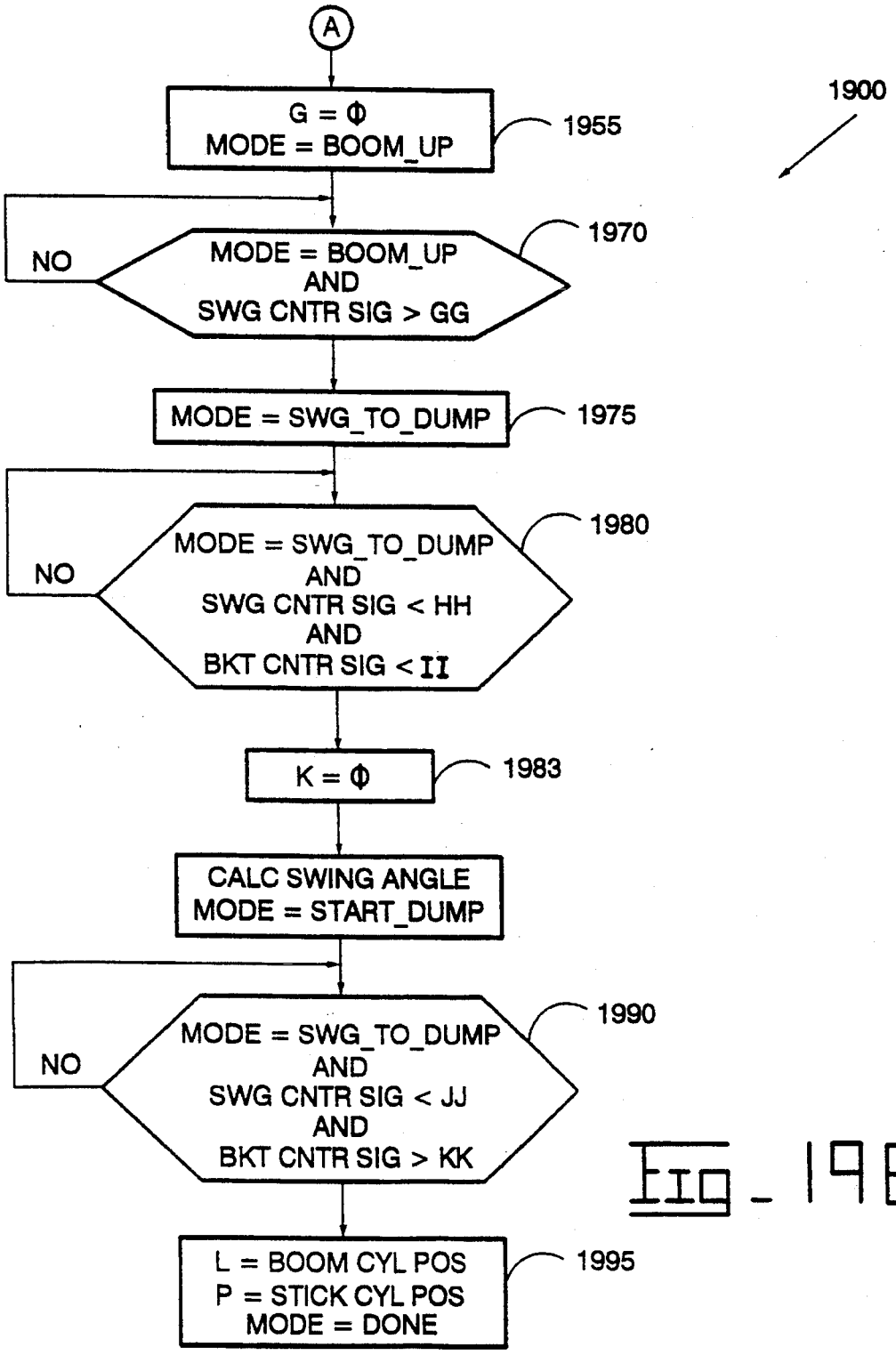

Accordingly, program control continues to block 1955, of FIG. 19B, to assign a setpoint G to the bucket angle $\phi$, and the variable MODE to BOOM_UP. Setpoint G represents the bucket angle at the end of digging.

Program control then proceeds to block 1970 to determine if the operator is swinging or rotating the work implement 100 from the dig location to the dump location. At block 1970, the control compares the operator control signal associated with the swing assembly 185 to a setpoint GG, which represents an operator control signal magnitude corresponding to a predetermined swing velocity. The result of this comparison indicates that the operator is swinging the work implement from the dig location to the dump location. Note that, for this discussion, an operator control signal magnitude having a positive value is associated with the work implement rotating in a clockwise direction, while an operator control signal magnitude having a negative value is associated with the work implement rotating in a counterclockwise direction, for example. Additionally the work implement is assumed to rotate from the dig location to the dump location at a clockwise direction, for example.

Once the control determines that the operator is rotating the work implement 100 to the dump location, then program control proceeds to block 1975 to assign the variable MODE to SWG_TO_DUMP.

Program control then continues to block 1980 to determine if the operator has started dumping the load from the bucket 120. At block 1980, the control compares the operator control signal associated with the swing assembly to setpoint HH, which represents an operator control signal magnitude corresponding to a predetermined swing velocity; whereby the comparison indicates that the rotation of the work implement 100 has slowed or stopped.

The control also compares the operator control signal magnitude associated with the bucket cylinder 150 to a setpoint II, which represents an operator control signal magnitude corresponding to a predetermined bucket velocity; whereby the comparison indicates that the bucket 120 is being "opened" and the load is being dumped from the bucket 120. Note that, the setpoint II may have a negative value indicative of the bucket cylinder retracting.

Program control then proceeds to block 1983 where the control assigns a setpoint K to the maximum amount of bucket curl determined during the BOOM-UP or SWG_TO_DUMP modes. The maximum amount of bucket curl, i.e., the bucket angle at which the load is captured, is represented by $\phi$.

Continuing to block 1985, the control determines the dump location and calculate the swing angle. The dump location corresponds to the area in which the operator deposited the load. The swing angle is defined as the amount of angular rotation for the work implement from the dig location to the dump location.

Finally, the control proceeds to decision block 1990, to determine if the dump portion of the work cycle is complete. At block 1990, the control compares the operator control signal magnitude associated with the swing assembly 185 to a setpoint JJ, which represents an operator control signal magnitude corresponding to a predetermined swing velocity; whereby the comparison indicates that the work implement 100 is being rotated from the dump location back to the dig location. Note that, the setpoint JJ may have a negative value. The control also compares the operator control signal associated with the bucket cylinder 150 to a setpoint KK, which represents an operator control signal magnitude corresponding to a predetermined bucket cylinder velocity; whereby the comparison indicates that the operator has completed dumping the load. Note that, setpoint KK may have a negative value.

The control then proceeds to block 1995 to assign a setpoint L to the current boom cylinder position, and assign a setpoint P to the current stick cylinder position. Setpoint L represents the boom cylinder extension required to clear the dump pile, while setpoint P represents the final stick position for dumping.

Once the learn function 1900 is complete and the operator parameters have been determined, i.e., the setpoints have been assigned, the control curves may be modified in response to the average stick cylinder force and bucket cylinder command signal magnitude calculated in block 1945. More particularly, the logic means 250 compares the calculations of block 1945 to values of the two-dimensional look-up tables shown in FIGS. 20 and 21 to determine material condition settings of the control curves.

Reference is now made to FIG. 20, which represents a table of predetermined force values that correspond to a plurality of predetermined material conditions. The logic means 250 matches the calculated force value with the predetermined force value and sets the material condition setting of the control curves of FIGS. 13, 14, and 15, and the curve of setpoint R of FIG. 12 to that shown in FIG. 20.

Referring now to FIG. 21, which represents a table of predetermined bucket command signal magnitudes that correspond to a plurality of predetermined material conditions. The logic means 250 matches the calculated bucket command signal magnitude with the predetermined command magnitude and sets the material condition setting of the control curves of FIG. 16 to that shown by the table of FIG. 21.

The values for the various setpoints, as well as curves illustrated on the various FIGS. may be determined with routine experimentation by those skilled in the art of vehicle dynamics, and familiar with the excavation process. Any values shown herein are for exemplary purposes only.

Industrial Applicability

Figure 22:
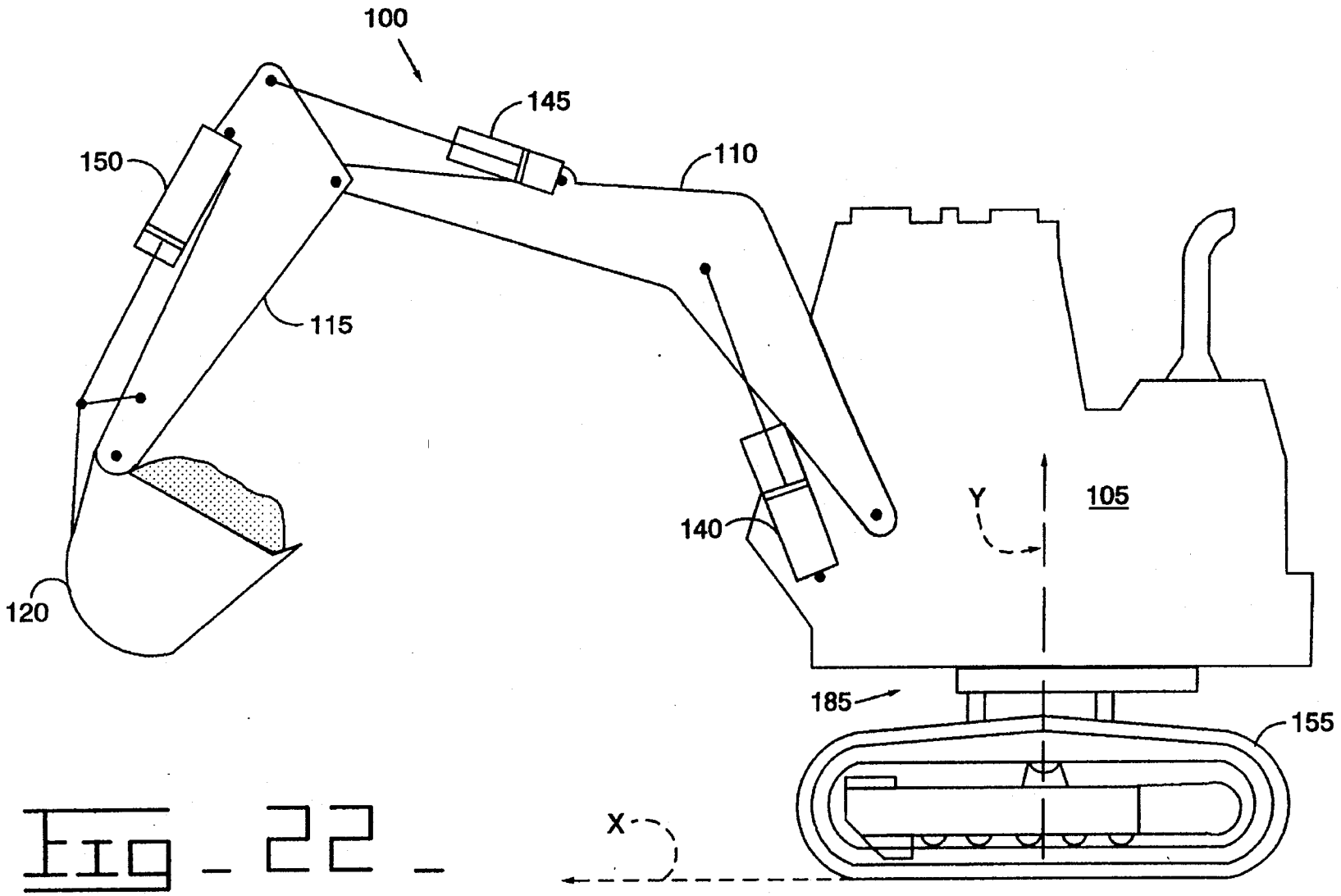
FIG. 22 is a side view of the excavating machine.

The operation of the present invention is best described in relation to its use in earthmoving vehicles, particularly those vehicles which perform digging or loading functions such as excavators, backhoe loaders, and front shovels. For example, a hydraulic excavator is shown in FIG. 22. Lines X and Y are lines of reference for the horizontal and vertical directions, respectively.

In an embodiment of the present invention, the excavating machine operator has at his disposal two work implement control levers and a control panel or operator interface 260. Preferably, one lever controls the boom 110 and bucket 115 movement, and the other lever controls the stick 115 and swing movement. The operator interface 260 provides for operator selection of operation options and entry of function specifications. For example, the operator may be prompted for a desired dig depth.

Figure 23:
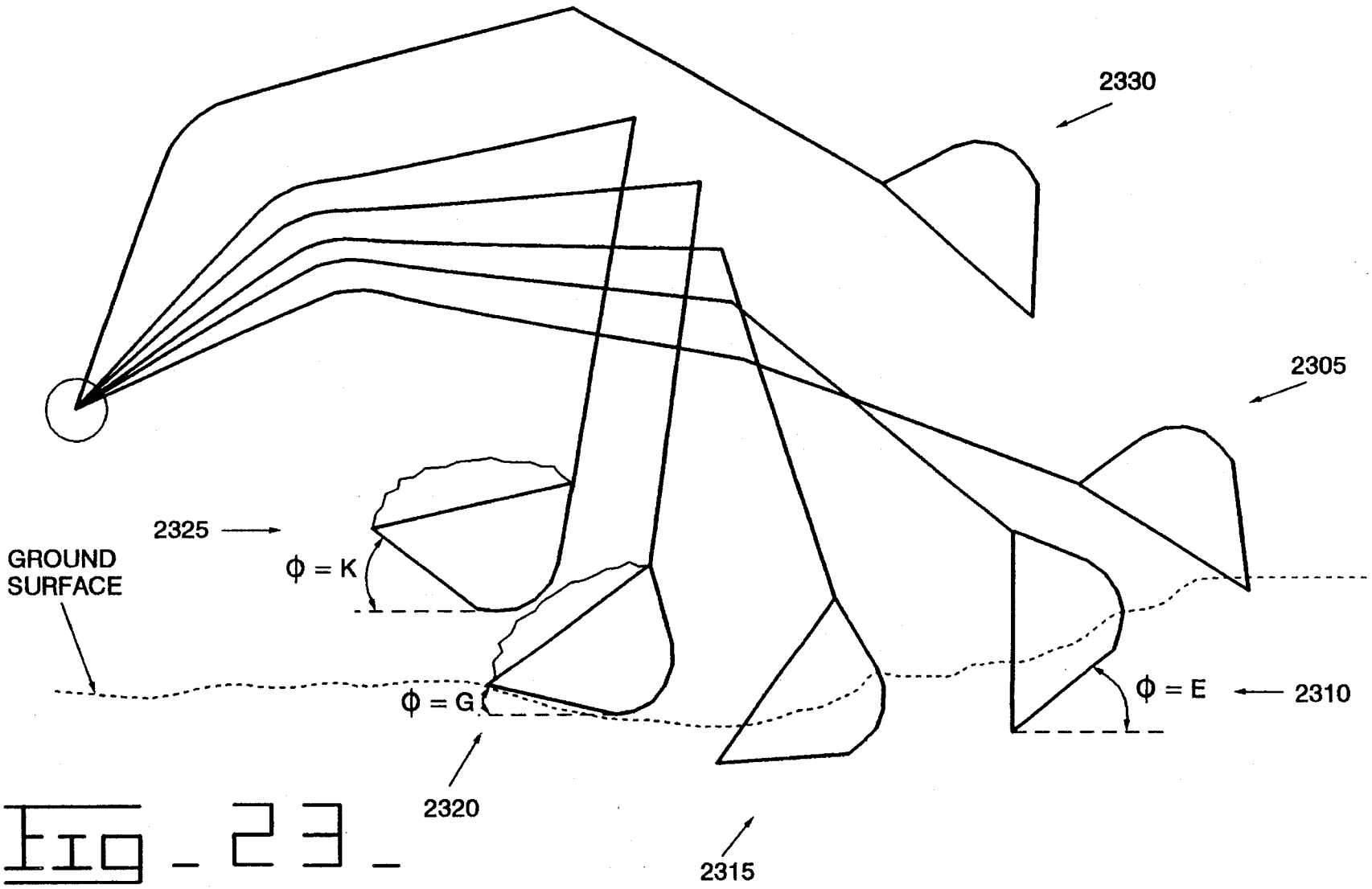
FIG. 23 is a diagrammatic view of the work implement during various portions of the excavation work cycle.

Reference is now made to FIG. 23, which illustrates various portions of an excavation work cycle. The following discussion pertains to the operation of the learn function 1900. First, the logic means determines the working envelope of the work cycle as defined by the operator. The working envelope is defined by predetermined setpoints associated with the work cycle based on the operator command signal magnitudes.

At 2305 the logic means 250 determines the completion of the boom-down portion of the work cycle in response to the operator lowering the boom 110 until the bucket 120 makes contact with the ground. Then the logic means 250 determines the cutting angle of the bucket 120, setpoint E, and the swing angle associated with the dig location at the start of the dig-stroke portion of the work cycle at 2310. As the operator controls the curling of the bucket 120, the retraction of the stick 115 and raising of the boom 110, the logic means 250 determines the average stick force and average bucket command signal magnitude during the dig-stroke portion of the work cycle at 2315. Once the logic means 250 determines that the operator is beginning the capture-load portion of the work cycle, thus signifying the completion of the dig-stroke portion, the logic means 250 determines the bucket angle at the end of digging, setpoint G, at 2320. Next, the logic means 250 determines the bucket angle to fully capture the load, setpoint K, in response to the operator completing the capture-load portion of the work cycle at 2325.

The logic means 250 then determines the dump location in response to the operator performing the dump-load portion of the work cycle at 2330, i.e., the operator controlling the swinging of the work implement 100 to the dump location, the raising of the boom 110, the extending of the stick 115, and uncurling the bucket 120. After the operator dumps the load, the logic means 250 determines the boom and stick cylinder positions, setpoints L and P, respectively.

Once the operator completes the work cycle, and the working envelope is determined, the logic means is now ready to perform autonomous excavating. First, the logic means 250 uses the average stick cylinder force and the average bucket command signal magnitude to estimate the material condition of the excavating soil, and selects the appropriate control curves to control the work implement in accordance with the working envelope. However, rather than simply repeat the work cycle of the operator, the logic means adapts the work cycle to the changing excavating environment to provide for efficient excavating.

Other aspects, objects and advantages of the present invention can be obtained from a study of the drawings, the disclosure and the appended claims.

We claim:

1. A control system for automatically controlling a work implement of an excavating machine through an excavation work cycle, the work implement including a boom, stick and bucket, each being controllably actuated by at least one respective hydraulic cylinder, the hydraulic cylinders containing pressurized hydraulic fluid, the control system comprising:

an operator control element adapted to produce an operator control signal indicative of a desired velocity of one of the hydraulic cylinders, said control signal including a control signal magnitude;

actuating means for controllably actuating predetermined ones of the hydraulic cylinders to perform an excavation work cycle in response to the control signal;

means for producing signals indicative of at least one force associated with at least one of the hydraulic cylinders;

means for receiving the operator control signals, comparing the control signal magnitudes to predetermined control signal magnitudes, and determining operating parameters associated with predetermined portions of the work cycle; and means for receiving the operator control signals and force signals, and responsively producing command signals to the actuating means to automatically perform subsequent work cycles in accordance with the determined operating parameters.

2. A control system, as set forth in claim 1, including a memory means for storing a plurality of control curves corresponding to a plurality of command signal magnitudes associated with a plurality of material condition settings.

3. A control system, as set forth in claim 2, including means estimating a condition of the excavating material in response to determining an average stick cylinder force and the average command signal associated with the bucket cylinder produced during a digging portion of the work cycle, and selecting one of the control curves in response to the estimated material condition.

4. A control system, as set forth in claim 3, wherein the operating parameters include a plurality of position and pressure setpoints, the control system further including:

position sensing means for producing respective position signals in response to the respective position of the boom, stick and bucket;

means for receiving the position signals, comparing at least one of the boom, stick and bucket position signals to a predetermined one of a plurality of position setpoints;

pressure sensing means for producing respective pressure signals in response to the associated hydraulic pressures associated with at least one of the boom, stick, and bucket hydraulic cylinders;

means for receiving the pressure signals, comparing at least one of the boom, stick and bucket pressures to a predetermined one of a plurality of pressure setpoints; and means for producing the command signals in response to the pressure and position comparisons.

5. A control system, as set forth in claim 4, including means for modifying the position setpoints in response to performing subsequent work cycles.

6. A method for automatically controlling a work implement of an excavating machine through an excavation work cycle, the work implement including a boom, stick and bucket, each being controllably actuated by at least one respective hydraulic cylinder, the hydraulic cylinders containing pressurized hydraulic fluid, the method comprising the steps of:

producing an operator control signal indicative of a desired velocity of one of the hydraulic cylinders, said control signal including a control signal magnitude;

controllably actuating predetermined ones of the hydraulic cylinders to perform an excavation work cycle in response to the control signal;

producing signals indicative of at lease one force associated with at least one of the hydraulic cylinders;

receiving the operator control signals, comparing the control signal magnitudes to predetermined control signal magnitudes, and determining operating parameters associated with predetermined portions of the work cycle; and receiving the operator control signals and force signals, and responsively producing command signals to automatically perform subsequent work cycles in accordance with the determined operating parameters.

7. A method, as set forth in claim 6, including the steps of storing a plurality of control curves corresponding to a plurality of command signal magnitudes associated with a plurality of material condition settings.

8. A method, as set forth in claim 7, including the steps of estimating a condition of the excavating material in response to determining an average stick cylinder force and the average command signal associated with the bucket cylinder produced during a digging portion of the work cycle, and selecting one of the control curves response to the estimated material condition.

9. A method, as set forth in claim 8, wherein the operating parameters include a plurality of position and pressure setpoints, the method further including the steps of:

producing respective position signals in response to the respective position of the boom, stick and bucket;

receiving the position signals, comparing at least one of the boom, stick and bucket position signals to a predetermined one of a plurality of position setpoints;

producing respective pressure signals in response to the associated hydraulic pressures associated with at least one of the boom, stick, and bucket hydraulic cylinders;

receiving the pressure signals, comparing at least one of the boom, stick and bucket pressures to a predetermined one of a plurality of pressure setpoints; and producing the command signals in response to the pressure and position comparisons.

10. A method, as set forth in claim 9, including the step of modifying the position setpoints in response to performing subsequent work cycles.

* * * * *

UNITED STATES PATENT AND TRADEMARK OFFICE

CERTIFICATE OF CORRECTION

PATENT NO. : 5,493,798

DATED : February 27, 1996

INVENTOR(S) : David J. Rocke et al

It is certified that error appears in the above-identified patent and that said Letters Patent is hereby corrected as shown below:

In claim 8, column 18, line 23, after the word "curves" should be the the word "in".

In claim 6, column 18, line 1, the word "lease" should be "least".

Signed and Sealed this

Sixth Day of August, 1996

*Attest:*

Bruce Lehman

BRUCE LEHMAN

*Attesting Officer*

*Commissioner of Patents and Trademarks*